US005502547A

United States Patent [19]

Shirai

[11] Patent Number: 5,502,547

[45] Date of Patent: Mar. 26, 1996

[54] SEALING DEVICE, PROCESS CARTRIDGE, IMAGE FORMING APPARATUS AND ASSEMBLING METHOD OF THE PROCESS CARTRIDGE

[75] Inventor: Masanari Shirai, Chigasaki, Japan

[73] Assignee: Canon Kabushiki Kaisha, Tokyo, Japan

[21] Appl. No.: 277,571

[22] Filed: Jul. 20, 1994

[30] Foreign Application Priority Data

Jul. 20, 1993 [JP] Japan ..... 5-178683
Jul. 13, 1994 [JP] Japan ..... 6-161461

[51] Int. Cl.[6] ..... G03G 21/00

[52] U.S. Cl. ..... 355/215; 355/200; 355/245; 355/260

[58] Field of Search ..... 355/215, 200, 355/210, 260, 245; 222/DIG. 1

[56] References Cited

U.S. PATENT DOCUMENTS

| | | | |
|---|---|---|---|
| 4,564,283 | 1/1986 | Fox | 355/215 |
| 4,888,620 | 12/1989 | Fujino et al. | 355/260 X |
| 5,212,521 | 5/1993 | Ogawa et al. | 355/215 |
| 5,274,425 | 12/1993 | Fukumoto et al. | 355/215 |
| 5,294,960 | 3/1994 | Nomura et al. | 355/260 X |
| 5,321,473 | 6/1994 | Azami | 355/245 |

FOREIGN PATENT DOCUMENTS

| | | | |
|---|---|---|---|
| 0113074 | 9/1980 | Japan | 355/215 |
| 0063961 | 4/1983 | Japan | 355/215 |
| 0185769 | 8/1986 | Japan | 355/215 |
| 0205971 | 9/1986 | Japan | 355/215 |
| 0192770 | 8/1987 | Japan | 355/215 |
| 0208073 | 9/1987 | Japan | 355/215 |
| 3-59578 | 3/1991 | Japan . | |
| 4-25877 | 1/1992 | Japan . | |

*Primary Examiner*—Matthew S. Smith
*Attorney, Agent, or Firm*—Fitzpatrick, Cella, Harper & Scinto

[57] ABSTRACT

A sealing device for use in a process cartridge including a cartridge frame, an image bearing member mounted in the cartridge frame, and process equipment, mounted in the cartridge frame, operative on the image bearing member, to prevent toner from leaking out of said cartridge frame. The sealing device includes a holder having an attachment position for detachably attaching the holder to the cartridge frame, a first sealing member, attached to the holder, capable of contacting a first position on the cartridge frame to prevent the toner from leaking out of said cartridge frame, and a second sealing member, separate from the first sealing member, attached to said holder and capable of contacting a second position on the cartridge frame, wherein the first position and the second position are different.

40 Claims, 15 Drawing Sheets

SEALING DEVICE, PROCESS CARTRIDGE, IMAGE FORMING APPARATUS AND ASSEMBLING METHOD OF THE PROCESS CARTRIDGE

BACKGROUND OF THE INVENTION

1. Field of the Invention

This invention relates to a sealing device easily attached and detached, a process cartridge capable of easily attaching and detaching the sealing device and its assembling method, and an image forming apparatus attachable of to the process cartridge.

2. Description of Related Art

Process cartridges integrating equipment such as an electrophotographic photosensitive drum, a charger, a developer, and a cleaning member into a united body so as to form a cartridge, having a construction in which a user, by detachably inserting such a cartridge into a body of the apparatus, can replace parts of a worn-out photosensitive drum and can supply toner, and thereby making its maintenance easy, are practically available these days. To save resources and energy or parts of such cartridges have been recycled and reused. Recycling is, as here, composed of, for example, crushing and melting the materials such as plastics used as parts to return to original materials and of manufacturing some products again. In contrast, reusing is, for example, to clean used parts when necessary or to process so as to regain functions of such used parts (for instance, such as coating solvent, polishing, or grinding) and to use them again as parts in the same application.

With such process cartridges, for example, parts such as the charging roller and the developing roller may be reusable even after toner in the cartridge has been consumed. Therefore, a recent tendency shows that such a cartridge is collected after its toner has been consumed and that the parts such as the rollers are taken out to be reused. The cartridge frame, itself, is also once crushed and melted, and then used as plastic material for cartridge frame again, or cleaned to be reused as parts.

A conventional cartridge frame is made with sealing devices adhering to some portions thereof to prevent the contained developer (hereinafter called "toner " from scattering outside of the frame. For example, in a cleaning station, a cleaning blade 51 and a collecting sheet 52 are provided to a cleaning frame 50 as shown in FIG. 17. Sealing members 53, 54 are attached by adhesive to the bottoms of the cleaning blade 51 and the collecting sheet 52, respectively, to prevent the toner from leaking out of the ends in a longitudinal direction of the blade 51 or the sheet 52. End sealing members 56 are attached by adhesive to the cleaning frame 50 to prevent the toner from leaking from the clearances between the ends in the longitudinal direction of a photosensitive drum 55 and the cleaning frame 50.

When assembling such process cartridges, an operator must mount those plural sealing members to each cleaning frame and is thereby required to be involved in such complicated work. Those sealing members may impair the quality of reproduced products if mixed with impurities when plastic frames are melted to be recycled because such sealing members are formed of materials such as soft polyurethane foam. Accordingly, sealing members and adhesive have to be removed from the frame when the frame is to be recycled. Moreover, when such frames are reused, such sealing members are necessarily removed because the products cannot be reused as parts unless the sealing members are sufficiently removed. However, it is difficult to completely remove the sealing members and adhesive, which directly adhere to the cartridge frame, so that the removing process results in laborsome and complicated process.

SUMMARY OF THE INVENTION

This invention is intended to solve the problems on the conventional cartridges. It is an object of the invention to provide a sealing device capable of easily attaching and detaching sealing members and to provide a process cartridge, an image forming apparatus and an assembling process of the process cartridge.

The foregoing object is accomplished with a sealing device using a process cartridge, preventing the toner from leaking out of a cartridge frame of the process cartridge, and including a holder having at least one attachment for detachably attaching to the cartridge frame, and a plurality of sealing members independently contacting selected members between an image bearing member and process means.

In another aspect of the invention, an assembling method of a process cartridge for attaching an image bearing member and process means for operating with the image bearing member, includes the steps of attaching the sealing device, in which a plurality of sealing members independently contacting selected members among an image bearing member and process means is attached to a holder having at least one attachment for detachably attaching to the cartridge frame, and sealing clearances between the cartridge frame and the image bearing member or the process means.

According to the invention, the holder attached with a plurality of the sealing members is detachably attached to the cartridge frame, thereby enabling the sealing members to be readily attached to and detached from the cartridge frame. During an assembling process or a disassembling process, the plurality of the sealing members can be easily attached and detached, thereby improving efficiency of working productivity of such a process. Since not directly attached by adhesive the life to the cartridge frame, the sealing members are certainly detached, by pulling out them along with the holder out of the cartridge frame, without any part of adhesive or sealing members remaining in the cartridge frame, thereby enabling the process cartridge to be effectively recycled or reused.

BRIEF DESCRIPTION OF THE DRAWINGS

The above and other objects and features of the invention are apparent to those skilled in the art from the following preferred embodiments thereof when considered in conjunction with the accompanied drawings, in which.

DETAILED DESCRIPTION OF THE PREFERRED EMBODIMENTS

Figure 1:
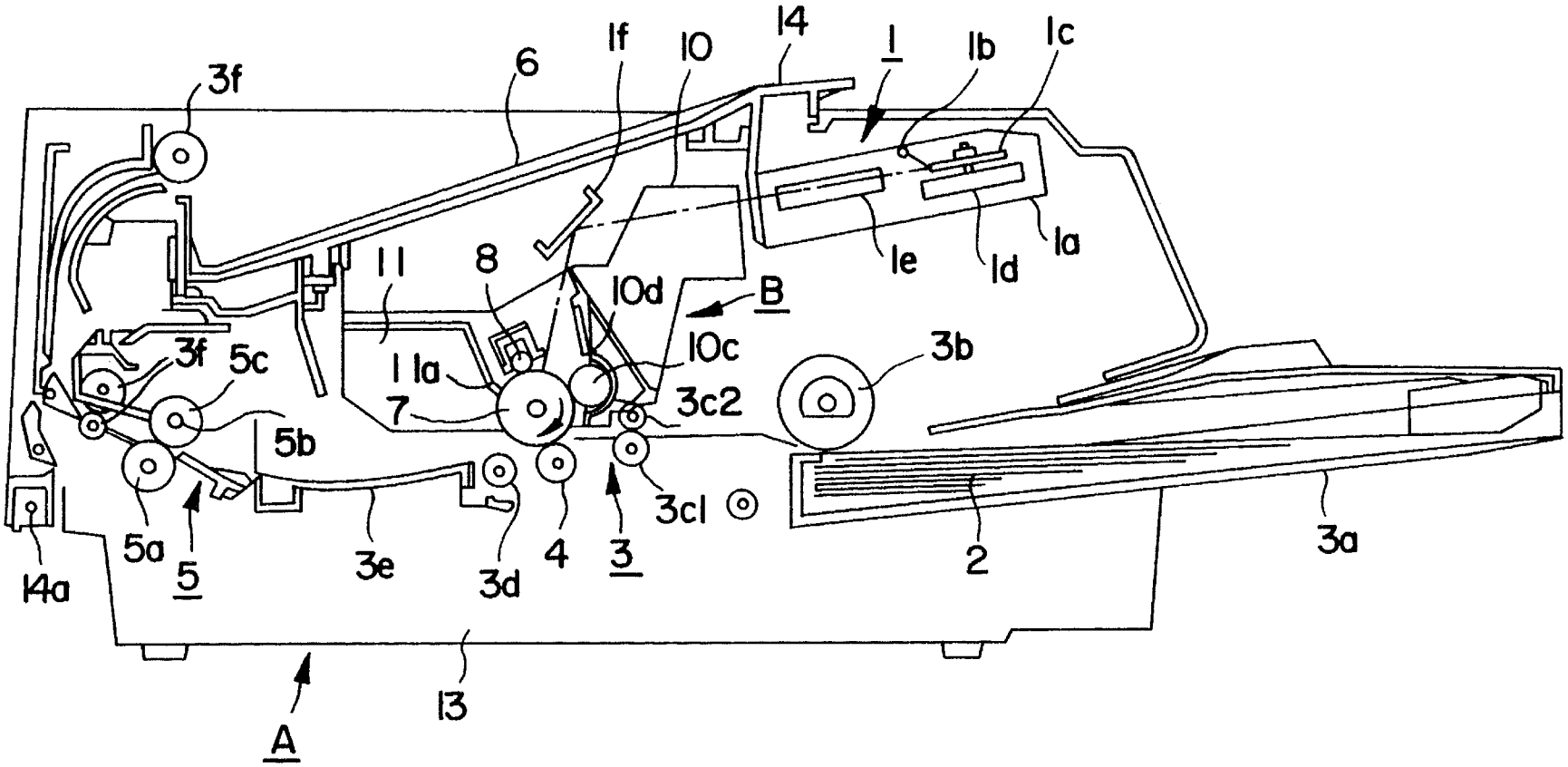
FIG. 1 is a schematic view illustrating a constitution of an image forming apparatus according to the invention.

Referring to the drawings, a preferred embodiment of the invention will be described in detail.

First Embodiment

Figure 2:
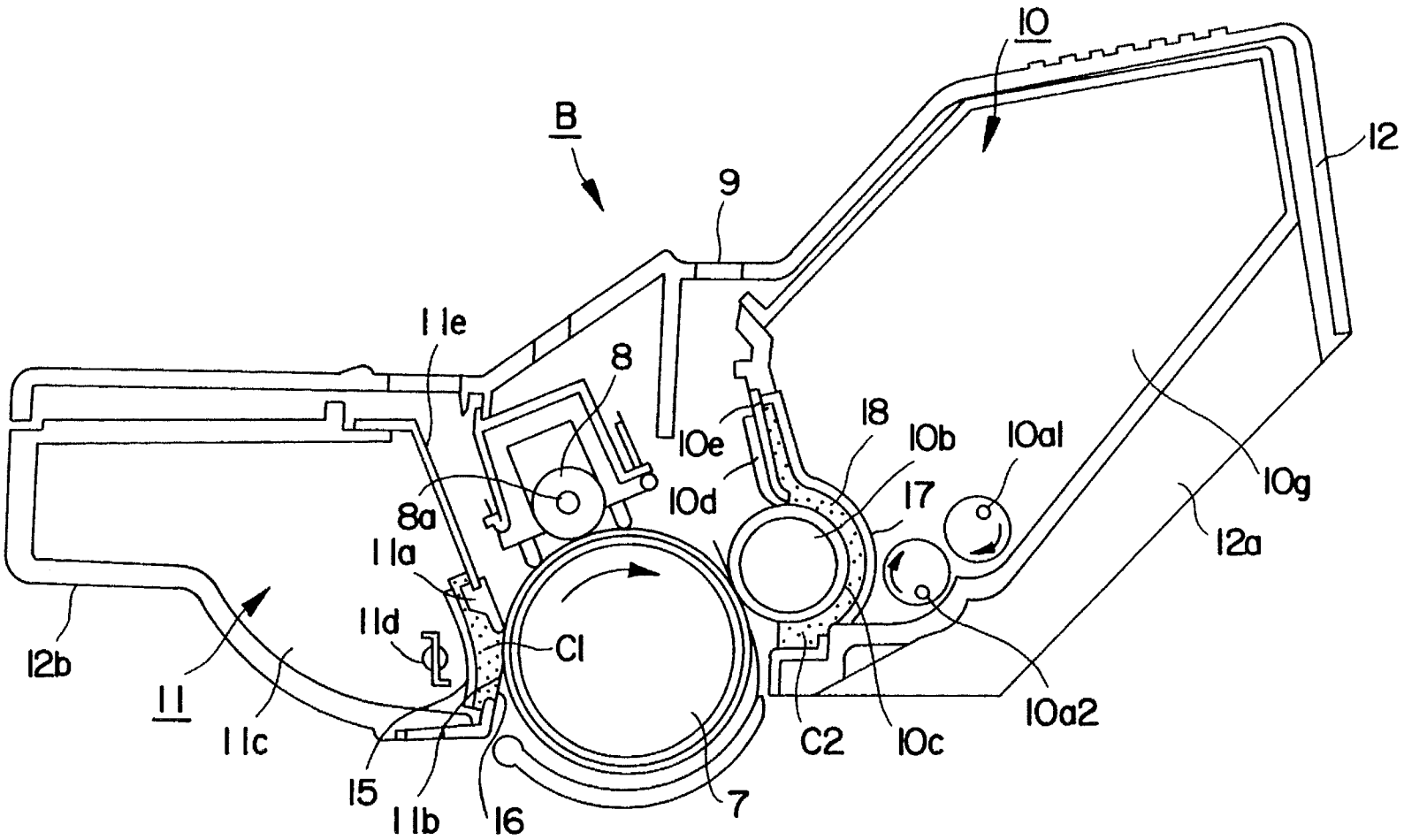
FIG. 2 is a schematic view illustrating a constitution of a process cartridge according to a first embodiment of the invention.

A first embodiment will be described as follows: first, the entire constitution of an image forming apparatus A attached with a process cartridge B; second, portions of the image forming apparatus A and the process cartridge B; and finally, constitutions of sealing members and sealing device. FIG. 1 is an illustration showing an image forming apparatus A attached with a process cartridge B according to the invention; FIG. 2 is a schematic view showing the process cartridge B.

[Entire Constitution]

The image forming apparatus A, as shown in FIG. 1, allows a light image based on image information to irradiate from an optical system to an electrophotographic photosensitive drum as an image bearing member to form a latent image on a curved surface of the photosensitive drum and forms toner image by clinging developer, namely, toner. The image forming apparatus A then conveys recording media 2 through conveying means 3 in synchronism with formation of the toner image and transfers, by transfer means 4, the toner image formed on the photosensitive drum, onto the recording media 2 at an image forming station which is integrating its parts as process cartridge B. The image forming apparatus A then conveys the recording media 2 to fixing means 5 to fix the transferred toner image onto the recording media 2, and sends them to delivery means 6.

The process cartridge B constituting the image forming part, as shown in FIG. 2, allows the photosensitive drum 7 to rotate to uniformly charge the surface of the drum by charging means 8. The optical system 1 irradiates light image to the photosensitive drum 7 through an exposure opening 9 to form latent image, and the developing means 10 forms the toner image corresponding to the latent image to visualize it. After the transfer means 4 transfers the toner image onto the recording media 2, the cleaning means 11 removes remaining toner on the photosensitive drum 7. Parts of the photosensitive drum 7 and the like are incorporated in a developing frame 12*a* and a cleaning frame 12*b*, which are forming a frame 12 and made of plastics, and are integrated as a cartridge.

[Image Forming Apparatus]

Regarding the constitution of each portion of the image forming apparatus A, the details of the optical system, the conveying means, the transfer means, the fixing means, and cartridge attaching means, will be described in this order.

[Optical System]

The optical system 1 is for irradiating a light image onto the photosensitive drum 7 based on image information read through an external device or whatever. In an apparatus body 13, as shown in FIG. 1, a laser diode 1*b*, a polygon mirror 1*c*, a scanner motor 1*d*, and lens 1*e* are contained in an optical unit 1*a*.

For example, when an external equipment, such as a computer or a word processor, gives an image signal to the apparatus, the laser diode 1*b* emits in accordance with the image signal, and its light is irradiated to the polygon mirror 1*c* as image light. The polygon mirror 1*c* rotates at a high speed by the scanner motor 1*d*, and the image light reflected at the polygon mirror 1*c* is irradiated to the rotating photosensitive drum 7 through the lens 1*e* and a reflecting mirror 1*f*, thereby forming latent image according to the image information by selectively exposing the surface of the photosensitive drum 7.

[Conveying Means for Recording Media]

The conveying means 3 for conveying the recording media (for example, paper for recording, OHP sheet, cloth, thin plate, or whatever) includes a mounting portion for a cassette 3*a* in the apparatus body 13. The conveying means 3 supplies, by a pick-up roller 3*b*, the recording media 2 in the cassette 3*a* set in the mounting portion sheet by sheet from the top thereof toward a pair of register rollers 3cl, 3*c*2, and conveys by the register roller pair 3cl, 3*c*2 the recording media 2 to the image transfer station so as to synchronize with operation of the image formation. The recording media 2 with a transferred image is conveyed to the fixing means 5 by a conveying roller 3*d* and a guide plate 3*e*, and then, the recording media 2 with a fixed image is delivered by a delivering roller 3*f* to delivery means 6 arranged at the top of the apparatus.

[Transfer Means]

The transfer means 4 is for transferring toner image, formed at the image forming station on the photosensitive drum 7, onto recording media 2. As shown in FIG. 1, the transfer means according to this embodiment is formed with a transfer roller 4. That is, the transfer roller 4 pushes the recording media 2 to the photosensitive drum 7 of the process cartridge B which is put in the apparatus, and by application of a voltage having the reverse polarity to that of the toner image formed on the photosensitive drum 7 to the transfer roller 4, the toner image on the photosensitive drum 7 is transferred onto the recording media 2.

[Fixing Means]

The fixing means 5 is for fixing toner image transferred onto recording media 2 by voltage application of the transfer roller 4. The fixing means 5 is, as shown in FIG. 1, constituted of a drive roller 5*a* rotating, a fixing roller 5*c* having a heater 5*b* inside and being rotated in pressurized contact with the drive roller 5*a*. That is, when the recording media 2 on which the toner image has been transferred at the image forming station passes between the drive roller 5*a* and the fixing roller 5*c*, pressure is applied by pressing force of both rollers 5*a*, 5*c*, and heat is applied by heat of the fixing roller 5*c*, so that the toner image on the recording media 2 is fixed on the recording media permanently.

[Process Cartridge Attaching Means]

Figure 3A:
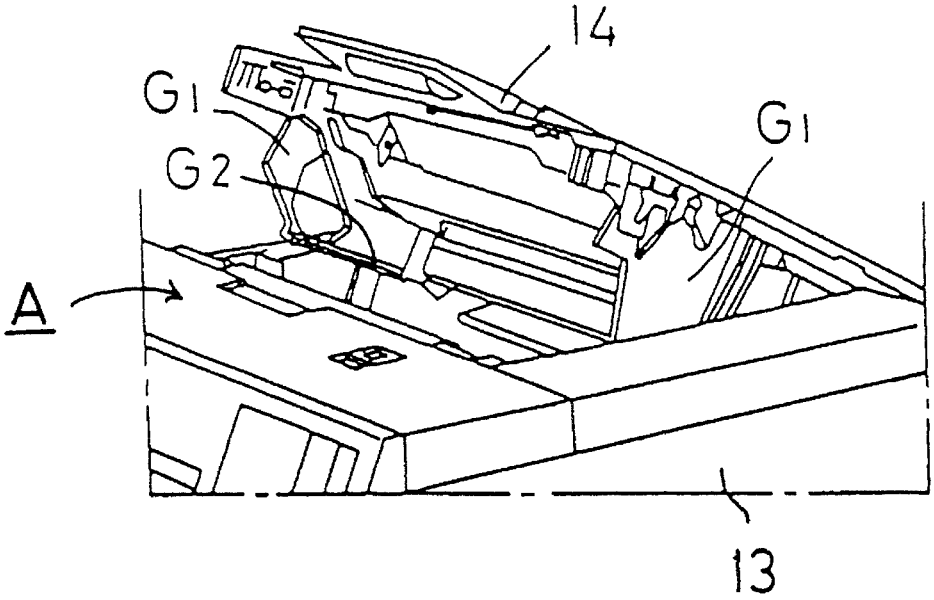
FIG. 3(*a*) and 3(*b*) are schematic views illustrating the process cartridge attached to the body of the image forming apparatus according to the first embodiment.
Figure 3B:
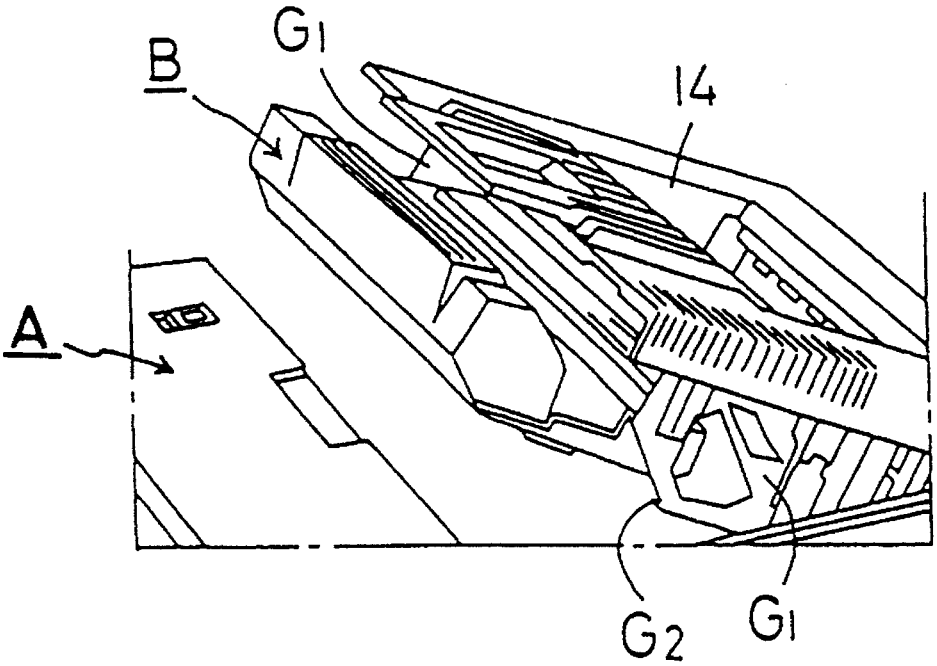

FIG. 3 illustrates the process cartridge attaching means for attaching the process cartridge B onto the image forming apparatus A. As shown in FIGS. 3(*a*), 3(*b*), when an opening cover 14 of the body of the image forming apparatus is opered up around a hinge not shown as a center, two guide members G1, G1 for guiding the process cartridge B at a time that the cartridge B is inserted along left and right inner sides of the cover 14 are seen. A bracket G2 is arranged for holding the process cartridge B so as to link the bottom ends of the left and right guide members G1, G1. The process cartridge B is mounted within the image forming apparatus A by inserting the process cartridge B along the guide members G1, G1 and the bracket G2, rendering the bracket G2 to hold the bottom of the process cartridge B, and closing the cover 14. Namely, those guide members G1, G1 and the bracket G2 become holders serving as stoppers for giving a fixed position of the process cartridge B in the image forming apparatus.

[Process Cartridge]

Each portion of the process cartridge B, which is attached in the image forming apparatus A, is described as follows.

The process cartridge B contains the process means, as well as the image bearing member. For example, the process means could be one or more of charging means for electrically charging the surface of the image bearing member, developing means for forming toner image from latent image formed on the image bearing member, cleaning means for removing the remaining toner on the surface of the image bearing member, and the like. In this embodiment, the process cartridge B is a united type process cartridge integrating the photosensitive drum, developing means, and cleaning means. That is, the process cartridge B arranges the charging means 8, the exposure opening 9, the developing means 10, and the cleaning means 11 around the electrophotographic photosensitive drum 7 as an image bearing member. The developing means 10 is mounted in a developing frame 12*a* forming a part of the cartridge frame 12, whereas the photosensitive drum 7, the charging means 8, and the cleaning means 11 are mounted in a cleaning frame 12*b* forming the other part of the cartridge frame 12, and those drum and means are formed into a united body.

Figure 5:
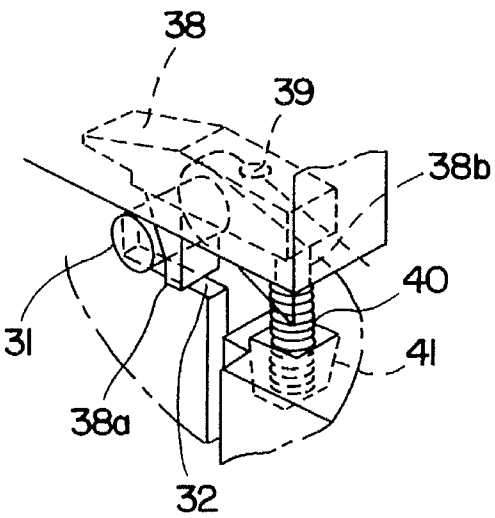
FIG. 5 is a perspective view showing a joint construction between the developing frame and the cleaning frame according to the first embodiment.
Figure 4:
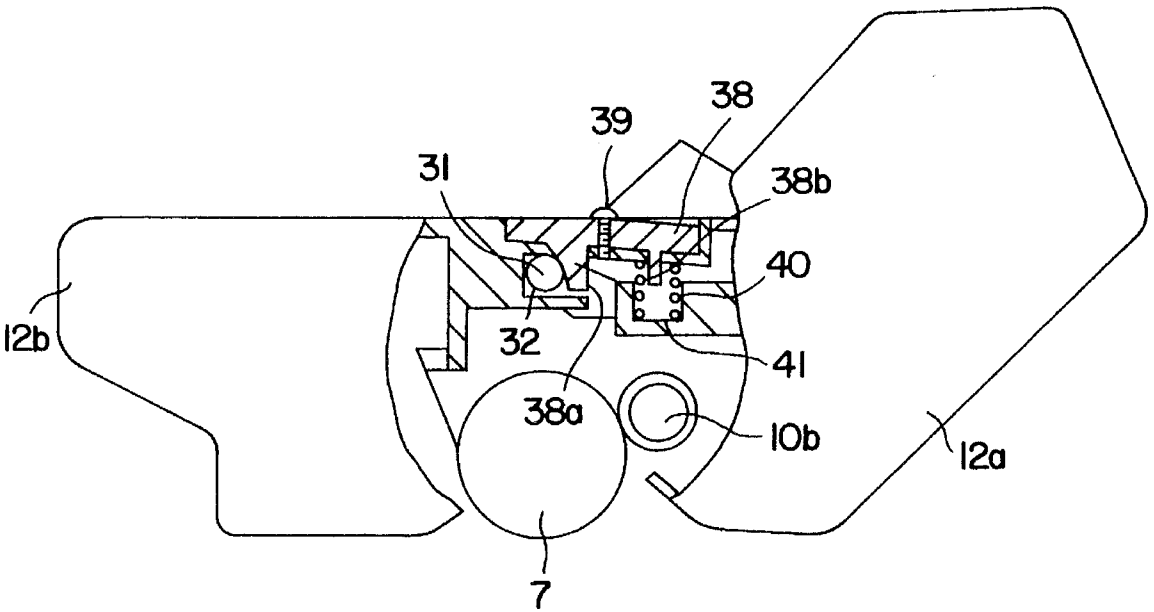
FIG. 4 is a schematic view illustrating a developing frame and a cleaning frame connected with each other according to the first embodiment.

FIGS. 4, 5 show a joint costruction of the developing frame 12*a* and the cleaning frame 12*b*. FIG. 4 illustrates mainly a joint construction of the developing frame and the cleaning frame and also illustrates schematically the entire construction of the process cartridge B. FIG. 5 is a perspective schematic view of the coupled structure. It is to be noted that the joint construction is not shown in FIG. 2 because it is formed at both ends in a width direction of the cartridge frame.

As illustrated in FIGS. 4, 5, when the photosensitive drum 7 is attached, a coupling boss 31 formed on the developing frame 12a so as to be located above the drum 7 fits into an coupling indent 32 of the cleaning frame 12*b*, so that the boss 31 and the indent 32 are positioned well. A screw 39 fixes a connector 38 to the developing frame 12*a*, and the developing frame 12*a* and the cleaning frame 12*b* are connected, because a first projection 38*a* arranged at the bottom of the connector 38 prevents the coupling boss 31 from being released from the coupling indent 32. A spring 40 is fitted at an outer peripheral surface of a second projection 38*b* of the connector 38, and is inserted, under being compressed, into a spring indent 41 on a side of the developing frame 12*a*.

Accordingly, the developing frame 12*a* and the cleaning frame 12*b* are rotatably coupled around the coupling boss 31 as a center, and the photosensitive drum 7 and the developing roller 10*c* are pushed toward one another by elastic force of the spring 40. Rings, not shown, having a thin thickness are mounted at the ends of the developing roller 10*c*, and contact with the curved surface of the photosensitive drum 7, thereby forming, between the photosensitive drum 7 and the developing roller 10*c*, a gap of the same size as the thickness of the ring.

Now, a constitution of each portion of the process cartridge B in the order of the photosensitive drum 7, the charging means 8, the exposure opening 9, the developing means 10, and the cleaning means 11 will be described.

[Photosensitive Drum]

The photosensitive drum 7 according to this embodiment has a drum base made of aluminum in a cylindrical shape and an organic photosensitive layer coated on the outer curved surface of the drum. The photosensitive drum 7 is rotatably mounted on the cleaning frame 12*b*, and is rotated in a direction of an arrow in FIG. 1 in accordance with operation of image formation, by transmission of drive force of a drive motor arranged on a side of the apparatus body to a flange gear secured at one end in longitudinal direction of the photosensitive drum 7, as described below.

[Charging Means]

The charging means is for uniformly and electrostatically charging the surface of the photosensitive drum 7, and this embodiment uses, so called, the contact charging method, as a method for charging, in which a charging roller 8 is rotatably mounted to the frame. The charging roller 8 is made from a conducting elastic layer around a metal roller shaft 8*a*, a high resistance elastic layer over the conducting elastic layer, and a protection film covering the high resistance elastic layer. Where the charging roller 8 contacts with the photosensitive drum 7, the charging roller 8 rotates by being driven by the rotation of the photosensitive drum 7 at a time of image formation, and at that time the surface of the photosensitive drum 7 is evenly charged by applying to the charging roller 8 the DC and AC voltages superimposed.

[Exposure Opening]

The exposure opening 9 is to allow light image from the optical system 1 to irradiate into the process cartridge B for exposing the surface of the photosensitive drum 7, which is evenly charged by the charging roller 8, in order to expose the light image and is arranged at the top of the cartridge frame.

[Developing Means]

The developing means 10, as shown in FIG. 2, has toner contained in a toner container 10g located in the developing frame 12*a*, and toner suppliers 10*a*l, 10*a* 2 for supplying toner are arranged so as to be rotatable. A fixed magnet 10*b* is located inside of the opening of the developing frame 12*a*, and a developing roller 10*c* for forming thin toner layer on the surface through a rotation of the roller is mounted with a narrow clearance, as described above, against the photosensitive drum 7.

The developing roller 10*c* is made of aluminum material of a cylindrical shape with a surface roughly furnished by a sandblast treatment or the like, and a conducting paint dispersing pigments is coated on the material. When a toner layer is to be formed on the surface of the developing roller 10*c*, the toner obtains friction charges enough to develop electrostatic latent image on the photosensitive drum 7 through friction between the toner and the developing roller 10*c*. A developing blade 10*d* is provided for limiting the thickness of the toner layer. The developing blade 10*d* is secured through screwing a blade supporter 10*e* to the developing frame 12*a*.

[Cleaning Means]

Figure 6:
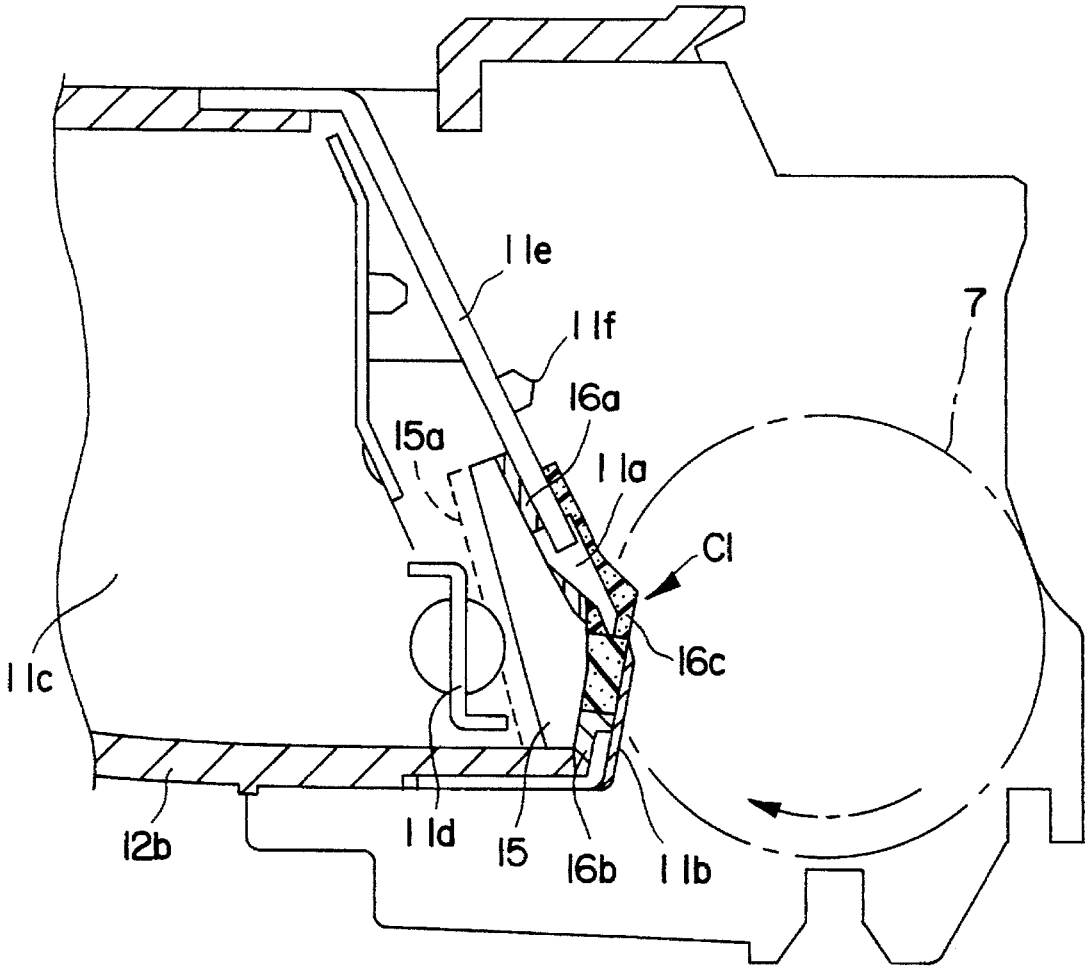
FIGS. 6, 7 are illustrations showing a sealing device attached to cleaning means according to the first embodiment.
Figure 7:
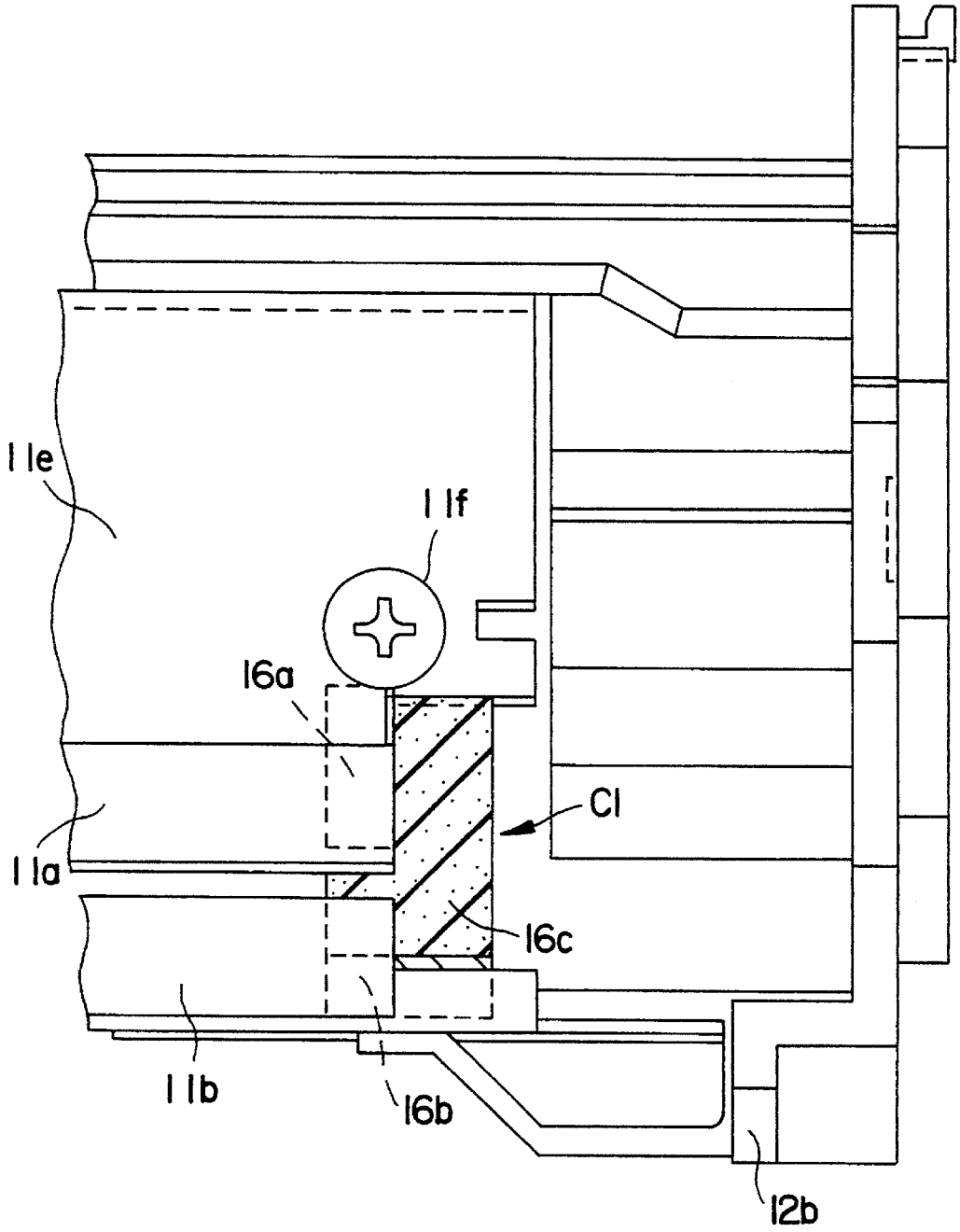

The cleaning means 11, as shown in FIGS. 2, 6, 7, contacts with the surface of the photosensitive drum 7. The cleaning means 11 includes an elastic cleaning blade 11*a* for scraping off the toner remaining on the drum 7, an elastic collecting sheet 11*b* placed below the cleaning blade 11*a* and in slightly contact with the photosensitive drum 7 for introducing the scraped toner to a toner reservoir 11*c*, feeding vanes 11*d* for feeding the collected toner to the toner reservoir 11*c*. The cleaning blade 11*a* is secured to a blade supporter 11*e*, which is fixed to the cleaning frame 12*b* by screws 11*f*. The collecting sheet 11*b* is directly attached to the cleaning frame 12*b* by a double-coated tape or whatever.

[Sealing Constitution]

Next, as a sealing constitution for preventing toner leakage, a constitution between the cleaning frame 12*b* and the cleaning members are described.

Figure 8:
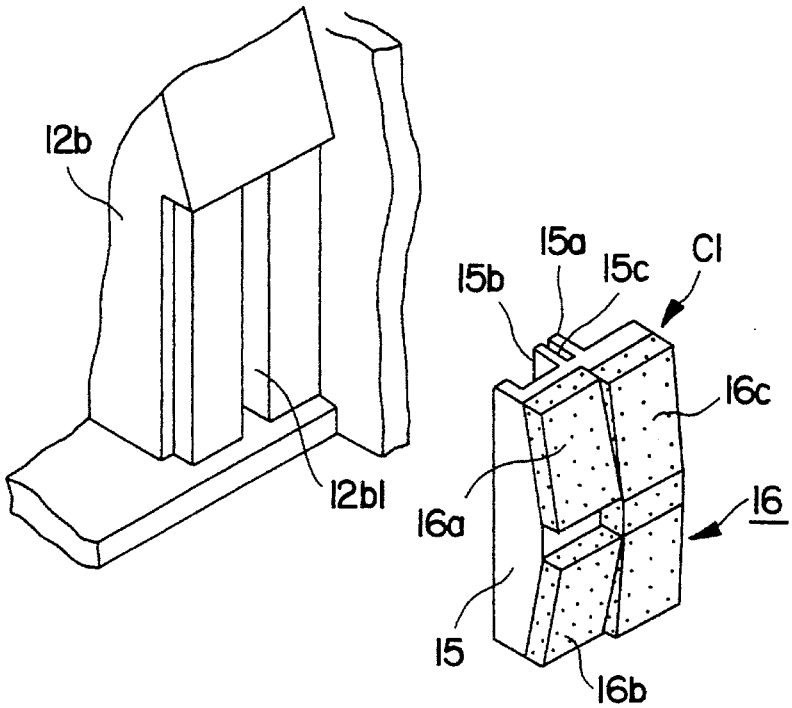
FIG. 8 is a perspective schematic view showing a cleaning sealing device according to the first embodiment.

In the cleaning frame 12*b* attaching the cleaning blade 11*a* and the collecting sheet 11*b*, the cleaning sealing devices C1 seal so as not to leak the toner from clearances of the cleaning frame 12*b* and by both ends in a longitudinal direction of the cleaning blade 11*a* and the collecting sheet 11*b*. In FIG. 7, only one end is shown; the cleaning sealing devices are attached to both ends, respectively, in the longitudinal direction of the photosensitive drum 7. The cleaning sealing device C1, as shown in FIG. 8, is composed of a holder 15 attaching three sheets of sealing members 16*a* to 16*c*, or simply numeral 16. Each sealing members 16*a* to 16*c* contacts with a respective location on the cleaning frame 12*b* and prevents the toner from leaking out of the frame 12*b*.

Figure 9:
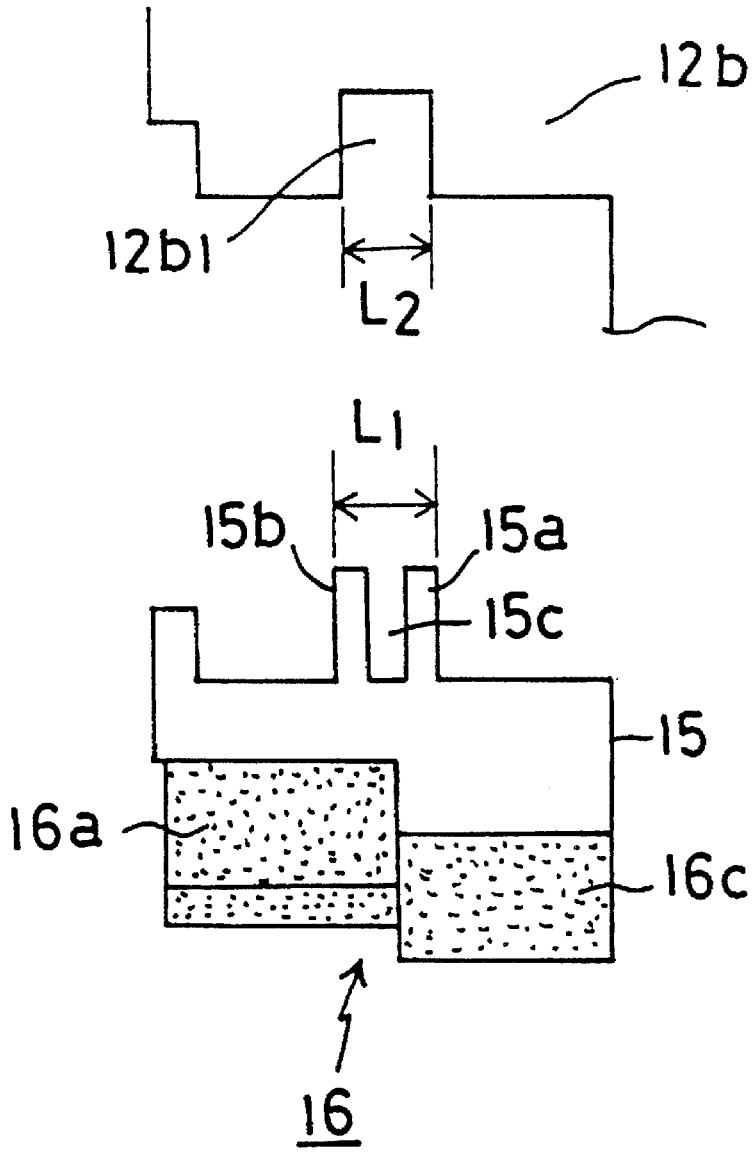
FIG. 9 is a schematic view illustrating an attachment of the cleaning sealing device according to the first embodiment.

The holder 15 is molded using elastic synthetic resin, such as polypropylene, polyethylene, and the like, and is formed in unity with a pair of tongues 15*a*, 15*b*, serving as attachments and having a predetermined space 15*c* therebetween, arranged on a face opposite to the face attaching the sealing members 16. A groove 12*b*l capable of being compulsively fitted with the tongues 15*a*, 15*b* is formed at the corresponding periphery of the cleaning frame 12*b*. As shown in FIG. 9, distance L1 between outside walls of the tongues 15*a*, 15*b* is a little larger than width L2 of the groove 12*b*l formed on the side of the cleaning frame 12*b*. Consequently, when the tongues 15*a*, 15*b* are inserted in the groove 12*b*l by elastically transforming them inward, or toward the space 15*c*, the tongues 15*a*, 15*b* are engaged to the inside walls of the groove 12*b*l by friction enhanced by elastic force, thereby detachably engaging the holder 15 to the cleaning frame 12*b*.

The sealing members 16 are plate pieces made of an elastic material, for example such as, soft polyurethane foam, and are made to adhere to a front face (a face orienting the photosensitive drum 7 where the drum 7 is mounted on the cleaning frame 12*b*; the same below) of the holder 15 by a double-coated tape or adhesive. A first sealing member 16*a* and a second sealing member 16*b*, in a row, and a third sealing member 16*c*, adjacent to them, adhere to the holder 15 as shown in FIG. 8. The face of the holder 15 for attaching the first and second materials 16*a*, 16*b* and the face of the holder 15 for attaching the third sealing member 16*c* are triangularly inclined so as to render the center thereof to jut forward; the surface for attaching the third sealing member 16*c* is gentler than the surface for attaching the first and second sealing members 16*a*, 16*b*, so that a gap is produced between both faces.

As shown in FIGS. 6, 7, after the cleaning sealing device C1 is attached to the groove 12*b*l, when the cleaning blade 11*a* and the blade supporter 11*e* are secured to the cleaning frame 12*b*, the front of the first sealing member 16*a* closely contacts with the rear of the ends in the longitudinal direction of the cleaning blade 11*a* and the blade supporter 11*e* (the face orienting toward the cleaning frame 12*b*; the same below), thereby preventing the toner from leaking through the clearance between the cleaning blade 11*a* or the like and the frame 12. When the collecting sheet 11*b* is attached, the front of the second sealing member 16*b* closely contacts with the rear of the ends in the longitudinal direction of the collecting sheet 11*b*, thereby preventing the toner from leaking through the clearance between the collecting sheet 11*b* and the frame 12*b*. Then, when the photosensitive drum 7 is mounted on the cleaning frame 12*b*, the front of third sealing member 16*c*, or an end sealing member, closely contacts with the curved face at the ends in the longitudinal direction of the photosensitive drum 7, thereby preventing the toner from leaking through the clearance between the photosensitive drum 7 and the frame 12. A flexible tape having less friction resistance could be put on the front of the third sealing member 16*c* to improve the nature against sliding.

These sealing members 16 (16*a* to 16*c*) are independently attached to the holder 15. When the sealing members 16 (16*a* to 16*c*) closely contact with the cleaning blade 11*a*, the collecting sheet 11*b*, the photosensitive drum 7 and the like, respectively, each material is independently compressed, so that other materials are never affected and transformed. Accordingly, even if clearances are made complicated, the cleaning sealing device C1 certainly seals the clearances and prevents the toner leaking.

As described above, when the process cartridge B is assembled, the cleaning sealing device C1 is first attached to the cleaning frame 12*b*, and then, the cleaning blade 11*a* and the blade supporter 11*e*, the collecting sheet 11*b*, and finally, the photosensitive drum 7 are attached. Three of the sealing members 16*a* to 16*c* can be unitedly attached to the cleaning frame 12*b* by only a bit of work of attaching the cleaning sealing device C1, thereby improving its work efficiency.

The tongues 15*a*, 15*b* formed across the holder 15 are compulsively inserted into the groove 12*b* l of the cleaning frame 12*b*, thereby linearly engaging the cleaning sealing device C1 with the cleaning frame 12*b*. Therefore, no clearance passing from the inside to the outside of the cleaning frame 12*b* is produced between the cleaning sealing device C1 and the cleaning frame 12*b*, so that the cleaning sealing device C1 can surely prevent toner leaking. A groove, in contrast to this embodiment, could be formed on the holder 15, and tongues could be formed on the cleaning frame 12*b*. Such a combination will also obtain the same effect.

When a process cartridge B which has been used is collected to be recycled or reused, such as an operator, at a time that the cartridge B is disassembled, takes out the photosensitive drum 7, the cleaning blade 11*a*, and the collecting sheet 11*b*, in the order reverse of assembling process from the cleaning frame 12*b*, and then pulls the exposed cleaning sealing device C1 on the frame 12*b*. As a result, the operator can readily detach the cleaning sealing device C1.

As described above, in the image forming apparatus, the cartridge is readily recycled or reused because a part of the sealing members 16 and adhesive do not remain on the cartridge when such sealing members are removed. The sealing members are readily attached and detached because the sealing device does not use adhesive, not likewise the conventional, for attaching the sealing members, so that the sealing device can improve its work efficiency by simplifying processes of assembling and disassembling.

Figure 10:
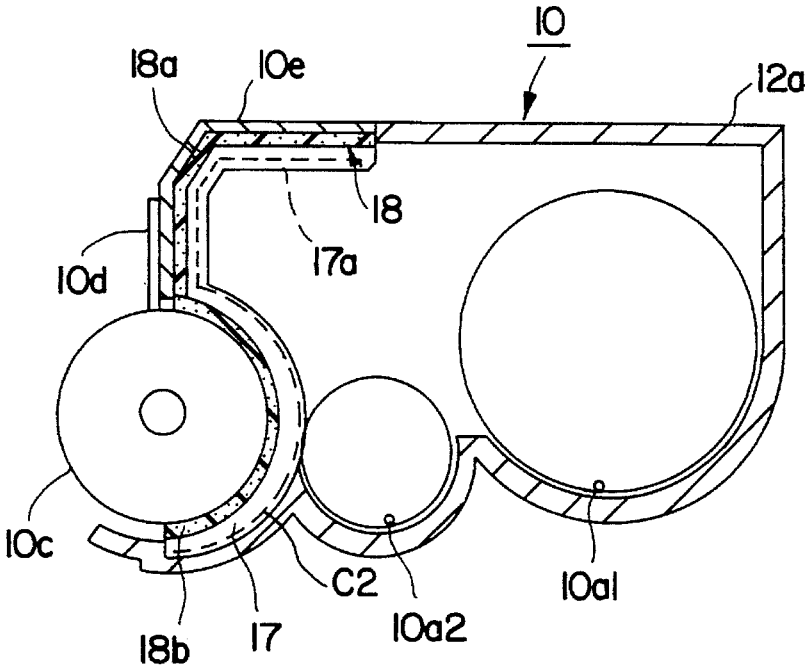
FIG. 10 is a schematic view illustrating a sealing device for developer attached to developing means according to the first embodiment.
Figure 11:
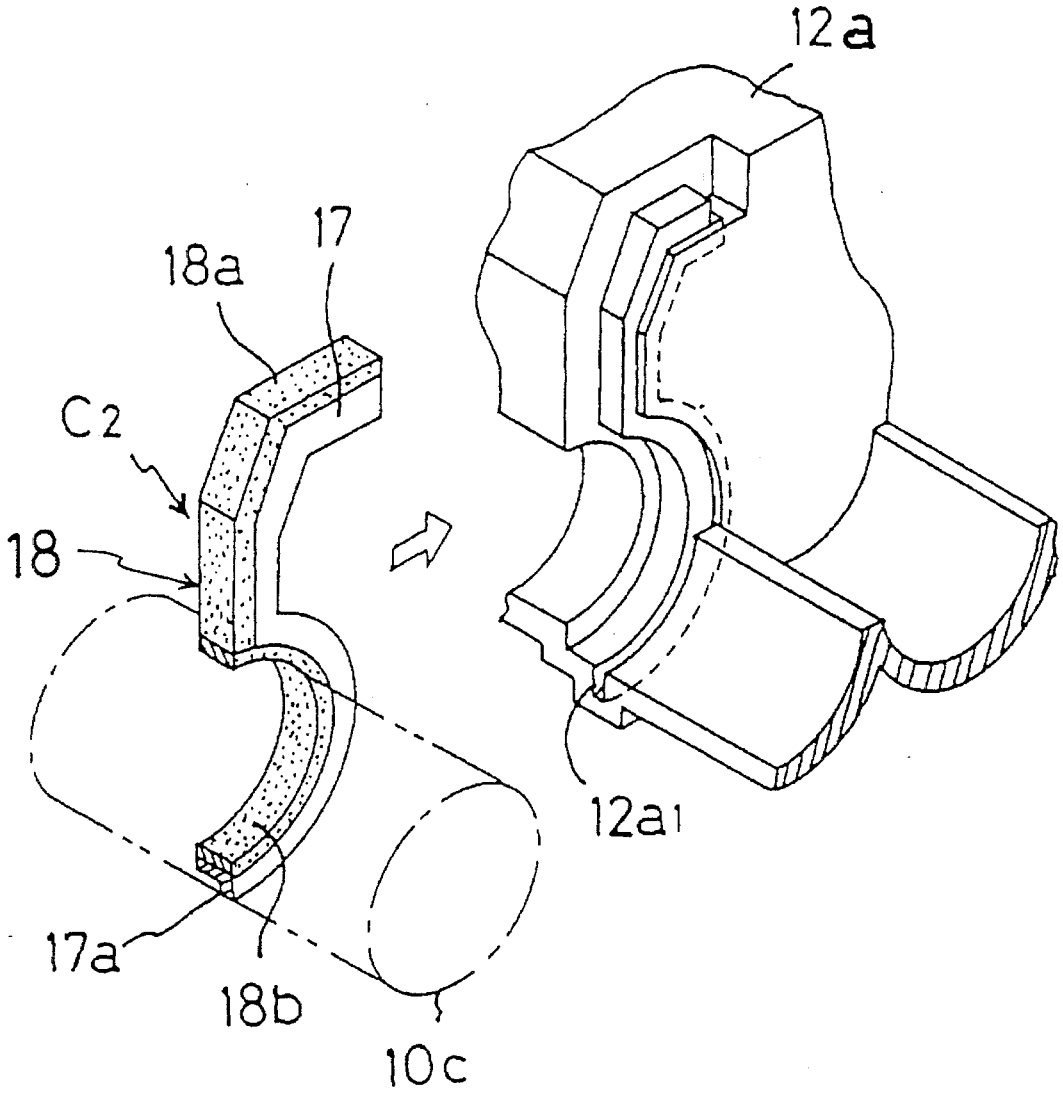
FIG. 11 is a perspective schematic view showing the sealing device for developer according to the first embodiment.

A sealing constitution of the developing means 10 is as follows. A developing sealing device C2, as shown in FIGS. 10, 11, is located among the frame 12*a*, the developing roller 10*c* and the developing blade 10*d*. In FIG. 11, only one end is shown; the developing sealing device C2 is attached to each end in the longitudinal direction of the developing roller 10*c*. The developing sealing device C2 is, likewise the cleaning sealing device C1 as described above, composed of a holder 17 attaching two sealing members 18*a*, 18*b* (or simply 18). The sealing members 18*a*18*b* are arranged to the developing frame 12*a* as described below, and contact with respective portions to prevent the toner from leaking out of the frame 12*a*.

The holder 17 is a member having a round bottom and is molded by such as an elastic synthetic resin mentioned above. The rear face of the holder 17 (the face opposed to the developing roller 10*c* when the developing roller 10*c* is mounted on the developing frame 12*a*; the same below) has a shape to closely contact with the developing frame 12*a*, and is formed with a tongue 17*a* extending across the holder 17 and serving as an attachment for the developing frame 12*a*. One the other hand, a groove 12*a* l allowing the tongue 17*a* to be compulsively inserted is formed on the front face of the developing frame 12*a* (a face orienting the developing roller 10*c*; the same below). The width of the tongue 17*a* is a little wider than the width of the groove 12*a* 1. The tongue 17*a* is elastically transformed by being compulsively pushed into the groove 12*a* 1, thereby engaging the holder 17 with the developing frame 12*a*.

As shown in FIG. 11, the first sealing member 18*a* and the second scaling member 18*b* adhere to the front top and the front bottom of the holder 17, respectively, by a double-coated tape or adhesive. In this embodiment, although the first scaling member 18*a* is molded of the soft polyurethane foam, the second scaling member 18*b*, in consideration of durability against sliding and ability of sealing, is made of a felt because the second scaling member 18*b* contacts with the rotating developing roller 10*c*.

The front of the first sealing member 18*a* closely contacts with the front at the ends in the longitudinal direction of the blade supporter 10*e* for supporting the developing blade 10*d*, thereby preventing the toner from leaking out of the clearance among the frame 12*a*, the supporter 10*e*, and the like. The front of the first sealing member 18*a* closely contacts with the curved face at the ends in the longitudinal direction of the developing roller 10*c*, thereby preventing the toner from leaking out of the clearance among the frame 12*a*, the developing roller 10*c*, and the like.

The first and second scaling members 18*a*18*b*, thus, arc independently and closely contacted with the developing blade 10*d* and the developing roller 10*c*, respectively, as well as in the cleaning means, so that deformation of one scaling device does not affect another, and so that the scaling device can prevent the toner from leaking by surely scaling the clearance.

The tongue 17*a* of the holder 17 and the groove 12*a*1 of the developing frame 12*a* are formed so as to extend across the developing sealing device C2, so that when the developing scaling device C2 is attached to the developing frame 12*a*, no clearance is produced between the developing sealing device C2 and the developing frame 12*a*, thereby rendering the toner far from leaking. A groove could be formed on the holder 17, and a tongue could be formed on the developing frame 12*a*. In such a combination, the sealing device will obtain the same effect.

When the process cartridge B is assembled, the developing frame 12*a* is assembled with, first, the developing sealing device C2, then, the developing blade 10*d* and the blade supporter 10*e*, and finally, the developing roller 10*c*, in this order. Two sheets of the sealing members 18*a*, 18*b* are unitedly attached to the developing frame 12*a* by only one-time work of attaching the developing sealing device C2, so that the sealing device can improve its work efficiency.

Furthermore, when the used cartridge B is collected from the market and then recycled or reused, an operator, at a time that the cartridge B is disassembled, takes out the developing roller 10*c* and the developing blade 10*d*, in the order reverse of assembling process from the developing frame 12*a*, and then pulls the exposed developing sealing device C2 on the frame 12*a*. As a result, the operator can readily detach the developing sealing device C2. When the sealing member 18 is removed, a part of the sealing member 18 or adhesive does not remain on the developing frame 12*a*, so that the cartridge B is readily recycled or reused. The sealing member 18 is readily attached and detached, thereby improving its work efficiency.

Second Embodiment

The second embodiment relates to a process cartridge, in addition to a sealing device, capable of easily attaching and detaching a photosensitive drum and a collecting sheet without using adhesive or screws. This process cartridge D is a separate type process cartridge having a photosensitive drum 21 and cleaning means, and developing means is incorporated in the image forming apparatus, otherwise to be attached as another cartridge.

Figure 12:
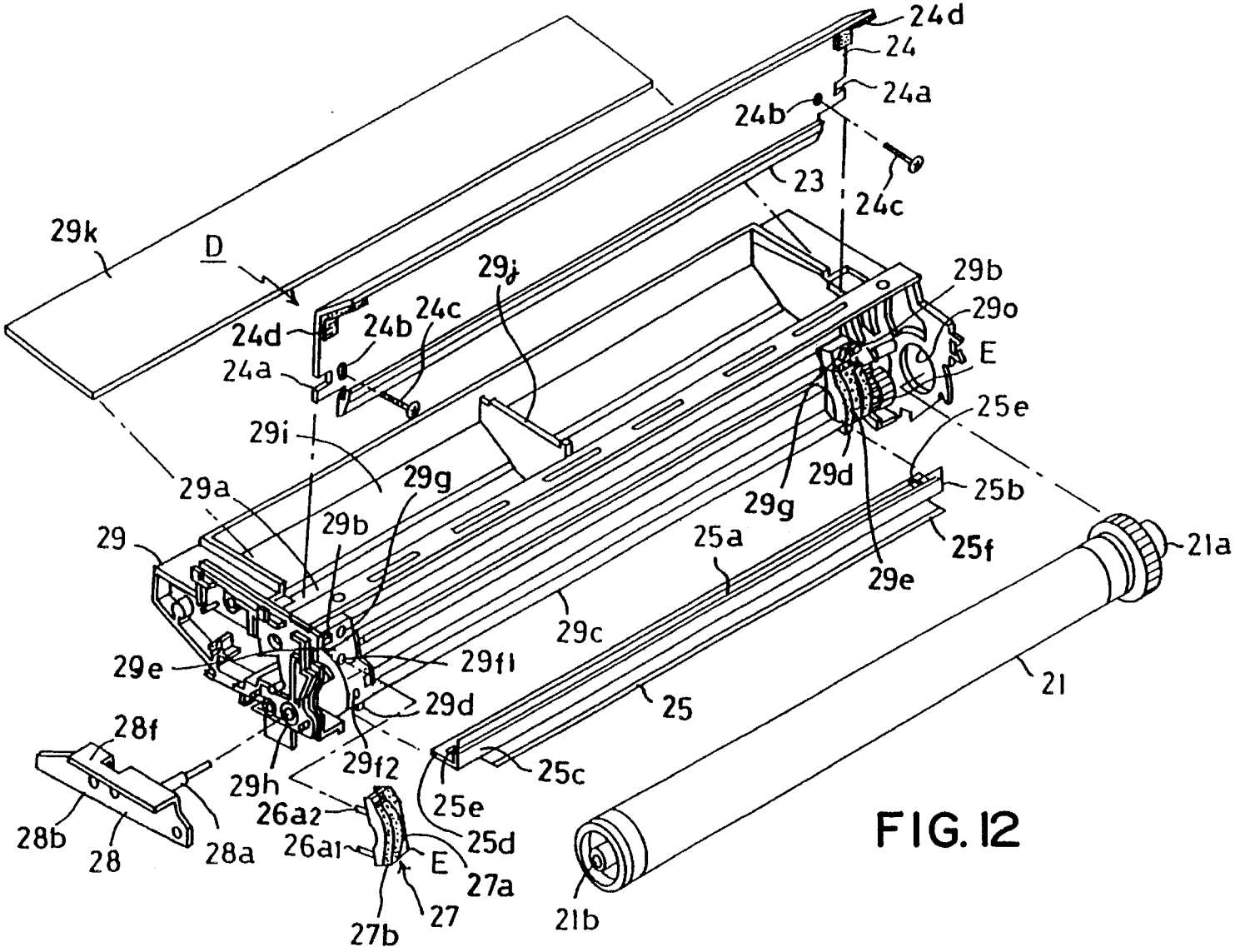
FIG. 12 is an exploded perspective view showing a component of cleaning means and an image bearing member according to a second embodiment of the invention.

FIG. 12 is an exploded perspective view of the process cartridge according to this embodiment. As shown in FIG. 12, the process cartridge D incorporates, unitedly in a cartridge frame 29 serving as a cleaning frame, a photosensitive drum 21, cleaning means constituted of a cleaning blade 23, a blade supporter 24 and a collecting sheet 25, and a cleaning sealing device E.

The cartridge frame 29 is a box unitedly made of a synthetic resin and has a toner reservoir 29*i* for containing used toner scraped by the cleaning blade 23 from the photosensitive drum 21. A partition plate 29*j* is provided in the toner reservoir 29*i*, thereby avoiding all toner to get gather at one side of the reservoir 29*i* even if the process cartridge D which has been taken out from the apparatus body is tilted. A lid 29*k* is put on the top of the toner reservoir 29*i* and is melted to adhere and secured, thereby sealing the toner reservoir 29*i*.

A construction attaching the cleaning blade 23 to the cartridge frame 29 is as follows. The cleaning blade 23 is attached by adhesive or the like to the bottom of the blade supporter 24. The blade supporter 24 is inserted downward to the slit 29*a* opened at the cartridge frame 29, and the bottom end of the blade supporter 24 is temporarily pulled up toward the front (a face orienting the photosensitive drum 21 when the photosensitive drum 21 is mounted on the cartridge frame 29; the same below), thereby positioning the supporter 24 through engaging cutouts 24*a*, 24*a* formed on the both ends of the supporter 24 with projections 29*b*, 29*b* of the cartridge frame 29. Screws 24*c*, 24*c* are passed via holes 24*b*, 24*b* formed on the both ends in the longitudinal direction of the blade supporter 24 and are secured to screw holes 29*g*, 29*g* of the cartridge frame 29 to fix the blade supporter 24. Sealing devices 24*d*, 24*d* are attached to the top of the both ends in the longitudinal direction of the blade supporter 24 and contact with the both ends in the longitudinal direction of the cartridge frame 29 to prevent the toner from leaking therefrom.

Figure 13:
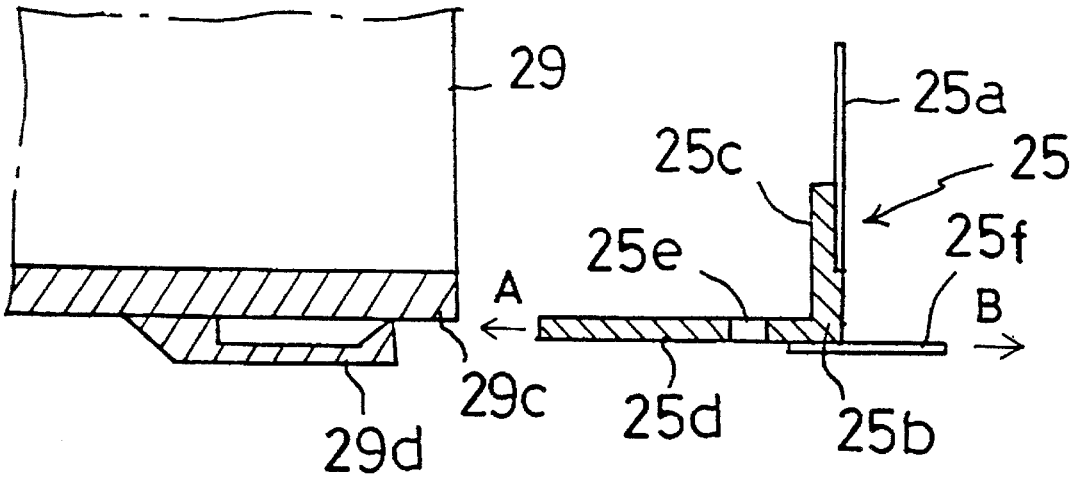
FIG. 13 is a schematic view illustrating an attaching structure of a collecting sheet according to the second embodiment.

An attachment construction of the collecting sheet 25 is, based on FIG. 13, described as follows. In the collecting sheet 25, an elastic thin blade 25*a* is attached onto a vertical side 25*c* of a bracket 25*b* having an L-shaped cross section. With positioning a horizontal side 25*d* of the collecting sheet 25 is placed in parallel to the cleaning blade 23 and attaching the horizontal side 25*d* to a bottom 29*c* on the front side of the cartridge frame 29, the collecting sheet 25 is fixed to the cartridge frame 29. That is, two holes 25*e*, 25*e* for engagement are formed on the horizontal side 25*d* of the bracket 25*b*, and if the bracket 25*b* is pushed down in A direction to a predetermined position along the bottom 29*c* of the cartridge frame 29, resin-made elastic clicks 29*d*, 29*d*, arranged on the bottom 29*c* of the cartridge frame 29, whose tip end is unfixed, engage with the holes 25*e*, 29*e* to position and secure the collecting sheet 25. When detaching the collecting sheet 25, the operator pulls down the clicks 29*d*, 29*d* to release the engagement between the clicks 29*d*, 29*d* and the holes 25*e*, 29*e* and, by pulling the collecting sheet 25 in B direction, namely, the opposite direction of the cartridge frame 29, can readily detach it. A sheet guide 25*f* extending toward the photosensitive drum 7 is attached to the bottom of the horizontal side 25*d* of the collecting sheet 25, thereby preventing the recording media from jamming. It is to be noted that, as an engaging construction for the collecting sheet 25, the clicks could be formed on the side of the collecting sheet 25 whereas the holes for engaging the clicks are formed on the side of the cartridge frame 29.

Figure 14:
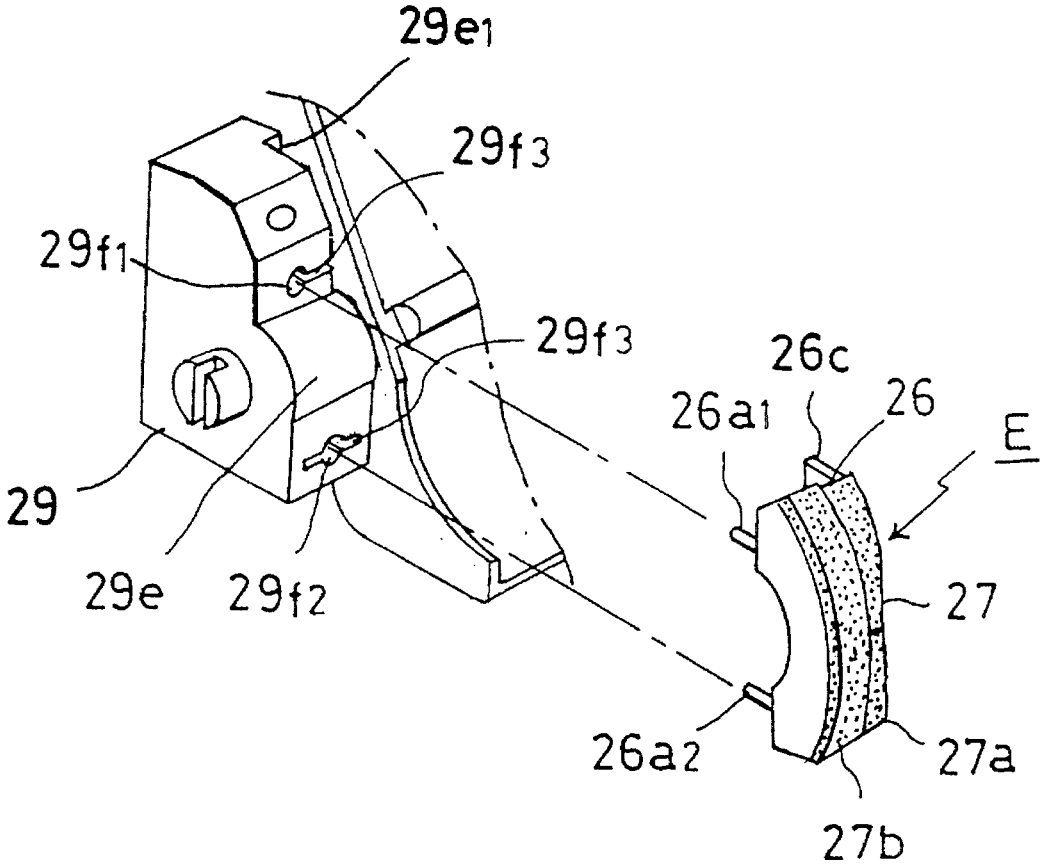
FIGS. 14, 15 are schematic views illustrating an attaching structure of a sealing device for cleaner according to the second embodiment.
Figure 15:
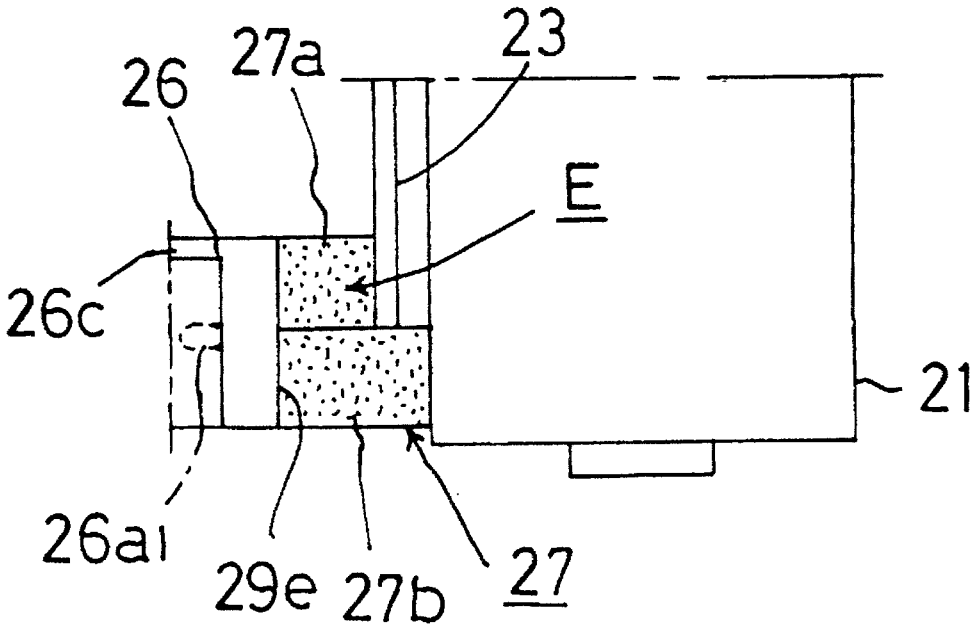

The cleaning sealing device E is a member for sealing a clearance among the photosensitive drum 21, the cleaning blade 23, the blade supporter 24, the collecting sheet 25, and the cartridge frame 29 so as to prevent the toner from leaking out of the cartridge frame 29. Referring to FIGS. 14, 15, an attachment construction of the cleaning sealing device E will be described.

The cleaning sealing device E is composed of two sealing devices 27 (27*a*, 27*b*) attached to the front of a holder 26. The holder 26 is an elastic member which is made of a synthetic resin, such as polypropylene, or polyethylene, whose rear face has a shape capable of closely contacting a mount 29*e* formed on both sides of the front of the cartridge frame 29. As shown in FIG. 15, the cleaning sealing device E is constructed so that a projecting plate 26*c* extending toward the cartridge frame 29 is formed on a side face side of an inside (a side orienting the center in the longitudinal direction of the photosensitive drum 21 mounted, after the holder 26 is settled on the mount 29*e*, on the cartridge frame 29; the same below) of the holder 26 and so that when the holder 26 is settled on the mount 29*e* the projecting plate 26*c* is inserted into a slit 29*e*1 to cover the corner of the mount 29*e* thereby rendering the toner unlikely to leak out of the clearance between the mount 29*e* and the holder 26. Notedly, FIGS. 14, 15 show only one end of the construction in the longitudinal direction of the cartridge frame.

As shown in FIG. 14, the holder 26 is formed with two projections 26*a*1, 26*a*2 for supporting the holder 26 onto the cartridge frame 29, and a mount 29*e* of the cartridge frame 29 is formed with holes 29*f*1, 29*f*2 permitting the projections 26*a* 1, 26*a*2 to compulsively fit thereinto. The holes 29*f*1, 29*f*2 have cutouts 29*f*3, 29*f*3 at their peripheries, respectively. When the projections 26*a*1, 26*a*2 are compulsively fitted into the holes 29*f*1, 29*f*2, the cutouts 29*f*3, 29*f*3, expand the holes 29*f*1, 29*f*2, in addition that the projections 26*a*1, 26*a*2, by the resin itself, are elastic, and therefore, the projections 26*a*1, 26*a*2 and the holes 29*f*1, 29*f*2 are bound with each other by friction, so that the holder 26 is detachably secured to the cartridge frame 29.

The sealing member 27 is formed of an elastic material such as soft polyurethane foam and adheres to the front side of the holder 26 by a double-coated tape or the like. As shown in FIG. 14, a first sealing member 27*a* and a second sealing member 27*b* adhere to the holder 26 in two rows. The second sealing member 27*b* has a curved front, which is more projected than the position of the first sealing member 27*a*. Therefore, when the photosensitive drum 21 and the cleaning blade 23 are mounted after the cleaning sealing device E is attached to the cartridge frame 29, the first sealing member 27*a* closely contacts with the front faces, at the ends in the longitudinal direction, of the cleaning blade 23 and the blade supporter 24, and the second sealing member 27*b* closely contacts with the curved face at the ends in the longitudinal direction of the photosensitive drum 21, thereby preventing the toner from leaking. The first sealing members 27*a* could be replaced with plurality of sealing members, each of which indepenently contacts with the cleaning blade 23, the blade supporter 24 and collecting sheets 25. A flexible tape having low resistance against friction could be attached onto the front of the second sealing member 27*b* to improve the durability of the sealing member against sliding.

Finally, an assembly method of the photosensitive drum 21 to the cartridge frame 29 is described as follows. A shaft 21*a* is projected from the end of the photosensitive drum 21. The shaft 21*a* is fitted into a first bearing hole 29*o* of the cartridge frame 29, and the other end of the photosensitive drum 21 is rotatably supported using a locking member 28, thereby rotatably mounting the photosensitive drum 21 onto the cartridge frame 29.

As shown in FIG. 12, the locking member 28 has a plate-shaped base 28*b* and a shaft 28*a* projected from the inner face of the base 28*b*. The shaft 28*a* of the locking member 28 is passed through a second bearing hole 29*h* of the cartridge frame 29 and fitted into a bearing hole 21*b* formed at the other end of the photosensitive drum 21.

Figure 16A:
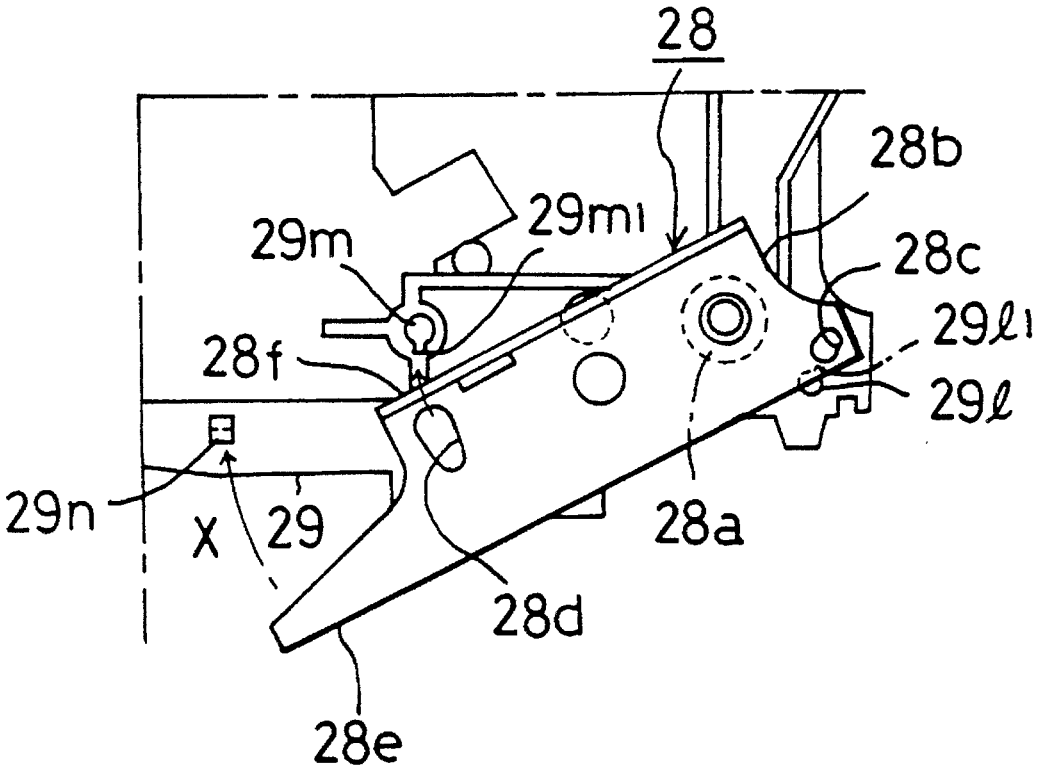
FIG. 16(*a*) and 16(*b*) are diagrams showing operation of connector for attaching a photosensitive drum according to the second embodiment.
Figure 16B:
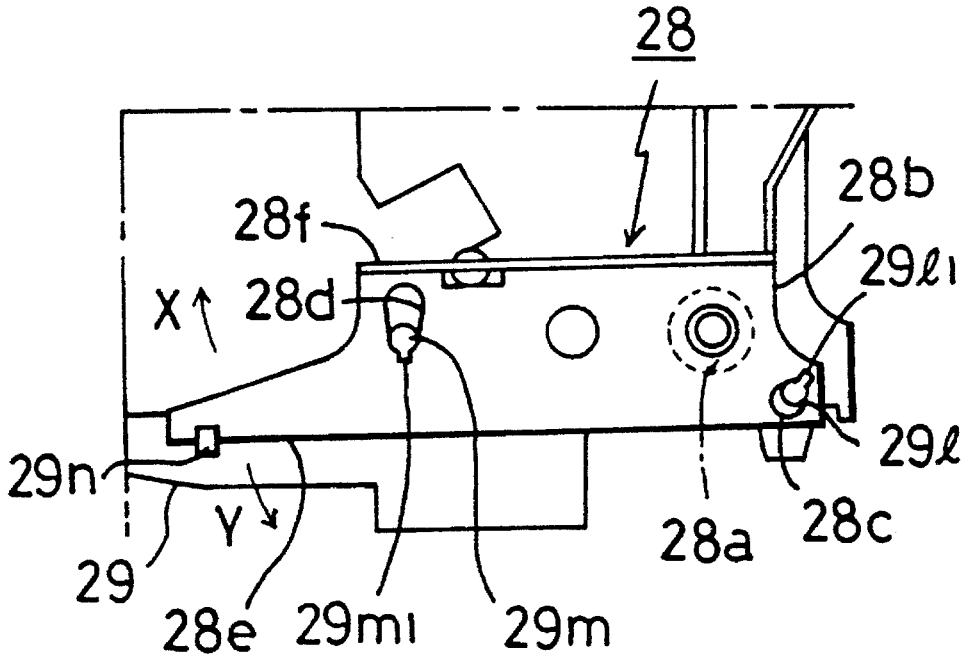
Figure 17:
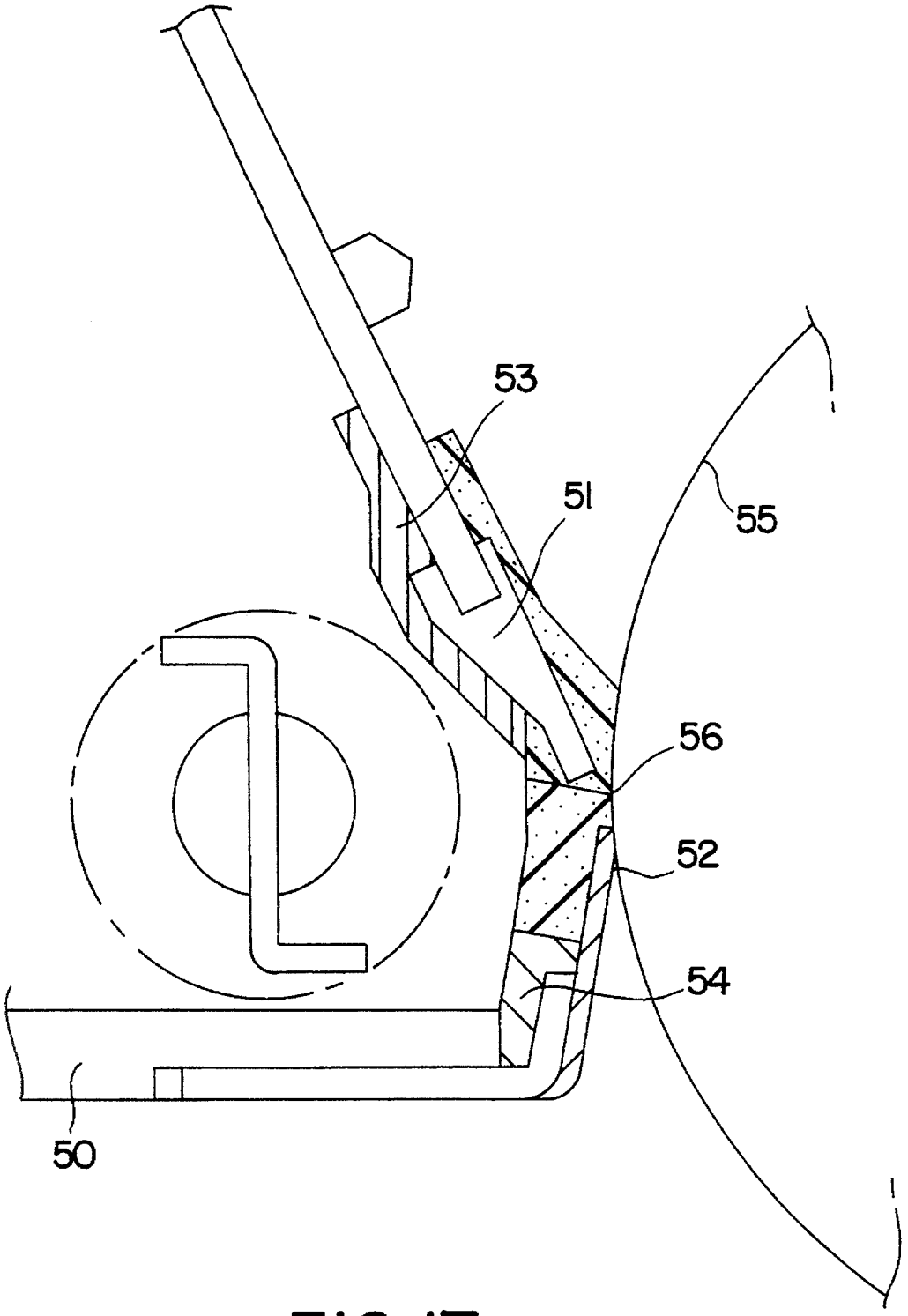
FIG. 17 (PRIOR ART)
FIG. 17 is a diagram showing a conventional cartridge.

FIG. 16 is a diagram showing operation of the locking member 28. As shown in FIG. 16 (*a*), the base 28*b* of the locking member 28 is formed with long holes 28*c*, 28*d*, respectively, corresponding to bosses 29*l*, 29*m* arranged on a side face of the cartridge frame 29. The top of the base 28*b* is folded so as to extend in the opposed direction to the shaft 28*a* to form a handle 28*f*. Those bosses 29*l*, 29*m* have tongues 29*l*1, 29*m*1 at their tips, respectively. The base 28*b* extends at its left side to form an arm 28*e*. A fixing click 29*n* to which the arm 28*e* engages is formed on a position, within a range that the arm 28*e* can reach, of the cartridge frame 29.

Upon inserting a part of the shaft 28*a* of the locking member 28 into the second bearing hole 29*h*, not shown in FIG. 16, of the cartridge frame 29, the locking member 28 is rotated around the shaft 28*a* as a center in a clockwise (arrow X) direction. When the long holes 28*c*, 28*d* of the locking member 28 overlapped the bosses 29*l*, 29*m* of the cartridge frame 29, the shaft 28*a* of the locking member 28 is completely pushed into the second bearing hole 29*h*, and the bosses 29*l*, 29*m* are put in the long holes 28*c*, 28*d*. At that time, the operator, by applying force to the handle 28*f*, can easily rotate the locking member 28 around the shaft 28*a* as a center.

Then, as shown in FIG. 16(*b*), if the locking member 28 is further rotated in X direction, the bosses 29*l*, 29*m* are stopped at the ends of the long holes 28*c*, 28*d*, thereby limiting further rotation of the locking member 28. At that time, the tongues 29*l*1, 29*m* 1 projected from the top curved ends of the bosses 29*l*, 29*m* overlap the edges of the long holes 28*c*, 28*d*, respectively, thereby disabling the locking member 28 to be pulled out. At the same time, the fixing click 29*n* arranged on the cartridge frame 29 engages to the bottom of the arm 28*e*, limiting the rotation of the locking member 28 in the reverse direction, or Y direction, and thereby surely forcing to stay the locking member 28 at the cartridge frame 29.

On the contrary, when the locking member 28 is detached, the operator or the like pulls the fixing click 29*n* downward, releasing the engagement of the fixed click 29*n* and the arm 28*e*, and if the locking member 28 is further rotated in Y direction, the engagements between the tongues 29*l*1, 29*m* 1 and the long holes 28*c*, 28*d* are released, so that the locking member 28 can be pulled out.

It is noted that, though when the photosensitive drum 21 is mounted a certain space will be produced over the drum 21, between the drum 21 and the cartridge frame 29, a charging roller can be mounted in such a space.

As described above, the process cartridge according to this embodiment is assembled by composing, to the cartridge frame 29, the cleaning sealing device E, the cleaning blade 23, the blade supporter 24, the photosensitive drum 21, in this order. When the process cartridge is recycled or reused, the process cartridge is disassembled by taking out each part in the reverse order to the order above. Although the collecting sheet 25 can be attached and detached in an arbitrary order, it is desirable to insert a process for the collecting sheet between an attaching or detaching process of the blade supporter 24 and an attaching or detaching process of the photosensitive drum 21, in order to prevent the photosensitive drum 21 from being destroyed in contact with the collecting sheet 25.

In accordance with the process cartridge of the second embodiment thus described, not only sealing members but also other members, such as the photosensitive drum and the collecting sheet, are readily attached to the cartridge frame without using adhesive, so that the process cartridge can improve work efficiency in the assembling process of the process cartridge and in the disassembling process of the process cartridge when recycled or reused.

It is to be noted that although in the second embodiment there describes the construction of the process cartridge having the cleaning means, the similar construction can be applied for a construction attaching a developing roller and a developing blade to a developing frame and further attaching developing sealing members and the like.

Other Embodiments

The process cartridge according to this invention thus described can be suitably applied to not only a cartridge for forming monochromic images but also a cartridge, provided with a plurality of developing means, for forming multicolor images (for example, bicolor color images, tricolor color images, full color images, or whatever). Regarding to a developing method, although in the first embodiment above so called the contact charging method is used, a construction, previously known as another construction, providing a metal shield such as aluminum so as to surround three quarters of a tungsten wire, locating positive or negative ions produced by a high voltage application to the tungsten wire to the surface of the photosensitive drum, and entirely charging the surface of the drum, can be, as a matter of course, used. It is to be noted that a blade type (a charging blade), a pad type, a block type, a rod type, a wire type, and whatever could be used as charging means, in addition to the roller type described above. A blade, a fur brush, a magnetic brush or whatever could constitute cleaning means as a cleaning method for remaining toner at the photosensitive drum. The process cartridge described above is defined as one equipped with, for example, an electrophotographic photosensitive body, as an image bearing member, and at least one process means. Accordingly, in addition to the embodiments above, the following combinations are possible as a feature of the process cartridge: one in which, for example, an image bearing member and charging means are unitedly formed into a cartridge that detachably attached to the apparatus body; one in which an image bearing member and developing means are unitedly formed into a cartridge that detachably attached to the apparatus body; one in which an image bearing member and cleaning means are unitedly formed into a cartridge that detachably attached to the apparatus body; one in which an image bearing member and a combination of two or more process means are unitedly formed into a cartridge that detachably attached to the apparatus body; or the like.

That is, the process cartridge is defined as: one in which charging means, developing means or cleaning means, and an electrophotographic photosensitive body are unitedly formed into a cartridge that detachably attached to the body of the image forming apparatus; one in which at least one of charging means, developing means or cleaning means, and an electrophotographic photosensitive body are unitedly formed into a cartridge that detachably attached to the body of the image forming apparatus; or furthermore one in which at least developing means and an electrophotographic photosensitive body are unitedly formed into a cartridge that detachably attached to the apparatus body.

Although the most preferred embodiment according to the invention was described above, the persons who are skilled in this art may reach other variations. Therefore, this invention will not be limited to the embodiments described above, and such other variations will be covered by the following claims.

What I claim is:

1. A sealing device for use with a process cartridge including a cartridge frame, an image bearing member mounted in said cartridge frame, and process means, mounted in the cartridge frame, operative on the image bearing member to prevent toner from leaking out of the cartridge frame, said sealing device comprising:

a holder having an attachment portion for detachably attaching the holder to the cartridge frame;

a first sealing member, attached to said holder, capable of contacting a first position on the cartridge frame to prevent the toner from leaking out of the cartridge frame; and a second member, separate from said first sealing member, attached to said holder and capable of contacting a second said cartridge frame position on the cartridge frame, wherein said first position and said second position are different.

2. A sealing device as set forth in claim 1, wherein said attachment portion comprises one of a projection or an indentation with which one of an indentation or a projection formed on the cartridge frame engages, wherein said projection is elastic and has a broader width than that of said indentation, and wherein when said projection is inserted into said indentation, said indentation and said projection engage with one another by friction.

3. A sealing device as set forth in claim 2, wherein said projection of either said holder or the cartridge frame is formed to be an extending projection, whereas said indentation of either said cartridge frame or the holder is formed to be a groove, whereby said holder engages linearly with the cartridge frame.

4. A sealing device as set forth in claim 1, wherein said sealing device seals a clearance between a cleaning means, as a component of said process means, and the cartridge frame, as well as a clearance between the image bearing member and the cartridge frame.

5. A sealing device as set forth in claim 4, wherein the cleaning means includes a cleaning blade for scraping toner from the image bearing member, a blade supporter for supporting the cleaning blade, and a collecting sheet for collecting the toner scraped by said cleaning blade, and further comprising a third sealing member attached to said holder, separate from said first and second sealing members, and wherein said first sealing member contacts an end, in a longitudinal direction, of the cleaning blade and the blade supporter; said second sealing member contacts an end in the longitudinal direction of the collecting sheet; and said third sealing member contacts a curved end surface of the image bearing member in a longitudinal direction thereof.

6. A sealing device as set forth in claim 4, wherein said cleaning means includes a cleaning blade for scraping toner from the image bearing member, a blade supporter for supporting the cleaning blade, and a collecting sheet for collecting the toner scraped by the cleaning blade, and wherein said first sealing member contacts a curved face at an end of the image bearing member in a longitudinal direction thereof.

7. A sealing device as set forth in claim 1, wherein said sealing device seals a clearance between a developing means, as a component of said process means and the cartridge frame.

8. A sealing device as set forth in claim 7, wherein the process cartridge includes a developing means, as a process means, the developing device including a developing blade for forming a toner layer on a developing roller and a blade supporter for supporting said developing blade, and wherein said first sealing member contacts an end, in a longitudinal direction, of the developing blade and the blade supporter; said second sealing member contacts a curved face at an end of the developing roller in a longitudinal direction thereof.

9. A sealing device as set forth in claim 1, wherein said first sealing member and said second sealing member contact each other when attached to said holder.

10. A sealing device as set forth in claim 1, wherein said first sealing member and said second sealing member are set apart from each other when attached to said holder.

11. A sealing device as set forth in any one of claim 1, 9, and 10, wherein said first sealing member and said second sealing members are plate-shaped members made of elastic material.

12. A sealing device as set forth in claim 11, wherein said elastic material is one of polyurethane foam or felt.

13. A sealing device as set forth in any one of claims 1, 9 and 10, wherein said holder is made of an elastic material.

14. A sealing device as set forth in claim 13, wherein said elastic material is one of polypropylene or polyethylene.

15. A sealing device as set forth in claim 1, wherein said holder is detachably attached to the cartridge frame by inserting a projection of said holder as said attachment portion into one of a hole or a groove formed on the cartridge frame.

16. A sealing device as set forth in claim 1, wherein said first sealing member and said second sealing member are attached to said holder with double-sided adhesive tape.

17. A process cartridge attachable to and detachable from the body of an image forming apparatus, comprising:

an image bearing member;

process means operative on said image bearing member;

a cartridge frame; and a sealing device including:

a holder having an attachment portion for detachably attaching said holder to said cartridge frame;

a first sealing member, attached to said holder, capable of contacting a first position on said cartridge frame to prevent the toner from leaking out of said cartridge frame; and a second sealing member, separate from said first sealing member, attached to said holder and capable of contacting a second position on said cartridge frame, which is different from the first position on said cartridge frame.

18. A process as set forth in claim 17, wherein said first position and said second position on said cartridge frame are proximate, respectively, to said image bearing member and a cleaning member as a component of said process means.

19. A process cartridge as set forth in claim 17, wherein said first position and said second position on said cartridge frame are proximate, respectively, to a developing roller and a developing blade holding member as a component of said process means.

20. A process cartridge as set forth in claim 17, wherein said process means comprises at least one of charging means, developing means, or cleaning means, and said image bearing member comprises an electrophotographic photosensitive body, are unitedly formed into a process cartridge that is detachable attached to the image forming apparatus.

21. A process cartridge as set forth in claim 17, wherein said process cartridge is defined as a process cartridge in which at least one of charging means, developing means, and cleaning means, corresponds to said process means, and an electrophotographic photosensitive body, as said image bearing member, are unitedly formed into a process cartridge that is detachable attached to an image forming apparatus.

22. A process cartridge as set forth in claim 17, wherein said process cartridge is defined as a process cartridge in which at least developing means, corresponds to process means, and an electrophotographic photosensitive body, as said image bearing member, are unitedly formed into a process cartridge that is detachable attached to an image forming apparatus.

23. A sealing device for use with a process cartridge including a carriage frame, an electrophotographic photosensitive drum mounted on said cartridge frame, and cleaning means mounted on said cartridge frame, for removing toner remaining on said electrophotographic photosensitive drum, to prevent toner from leaking out of said cartridge frame, said sealing device comprising:

a holder having an attachment portion for detachably attaching the holder to the cartridge frame;

a first sealing member, attached to said holder, to prevent the toner from leaking out of said cartridge frame, capable of contacting both a cleaning blade, as a component of said cleaning means, for scraping off the toner from a curved face of the electrophotographic photosensitive drum and a blade supporter, as a component of said cleaning means, for supporting the cleaning blade;

a second sealing member, attached to said holder, separate from said first sealing member, and capable of contacting to a collecting sheet, as a component of said cleaning means, for introducing scraped toner by the cleaning blade from said electrophotographic photosensitive drum into a toner reservoir; and a third sealing member, separate from said first and second sealing members, attached to said holder and capable of contacting the electrophotographic photosensitive drum.

24. A process cartridge attachable to and detachable from a body of an image forming apparatus, comprising:

an electrophotographic photosensitive drum;

cleaning means for removing toner remaining on said electrophotographic photosensitive drum;

a cartridge frame;

a sealing device comprising:

a holder having an attachment portion for detachably attaching said holder to said cartridge frame;

a first sealing member, attached to said holder, to prevent the toner from leaking out of said cartridge frame, capable of contacting both a cleaning blade, as a component of said cleaning means, for scraping off the toner from a curved face of said electrophotographic photosensitive drum and a blade supporter, as a component of said cleaning means, for supporting said cleaning blade;

a second sealing member, attached to said holder, separate from said first sealing member, to prevent the toner from leaking out of said cartridge frame, and capable of contacting a collecting sheet, as a component of said cleaning means, for introducing toner scraped from said electrophotographic photosensitive drum by said cleaning blade into a toner reservoir; and a third sealing member, separate from said first and second sealing members, attached to said holder and capable of contacting said electrophotographic photosensitive drum.

25. A process cartridge attachable to and detachable from the body of an image forming apparatus, comprising:

mounting means for detachably mounting said process cartridge including:

an image bearing member;

process means operative on said image bearing member;

a cartridge frame;

a sealing device, comprising:

a holder having an attachment portion for detachably attaching to holder to said cartridge frame;

a first sealing member, attached to said holder, capable of contacting a first position of said cartridge frame to prevent the toner from leaking out of said cartridge frame, and a second sealing member, separate from said first sealing member, attached to said holder and capable of contacting to a second position which is different from said first position of said cartridge frame, and conveying means for conveying said recording media.

26. An image forming apparatus as set forth in claim 25, wherein said image forming apparatus is an electrophotographic photocopier.

27. An image forming apparatus as set forth in claim 25, wherein said image forming apparatus is a laser beam printer.

28. An image forming apparatus as set forth in claim 25, wherein said image forming apparatus is a facsimile machine.

29. A process cartridge as set forth in either claim 17 or 25, wherein said first sealing member and said second sealing member contact each other when attached to said holder.

30. A process cartridge as set forth in either claim 17 or 25, wherein said first sealing member and said second sealing member are set apart from each other when attached to said holder.

31. A process cartridge as set forth in either claim 17 or 25, wherein said holder is detachably attached to said cartridge frame by inserting a projection of said holder as said attachment portion into one of a hole or a groove formed on said cartridge frame.

32. A process cartridge as set forth in either claim 17 or 25, wherein said first sealing member and said second sealing member are plate-shaped members made of an elastic material.

33. A process cartridge as set forth in claim 32, wherein said elastic material is one of polyurethane foam or felt.

34. A process cartridge as set forth in either claim 17 or 25, wherein said holder is made of an elastic material.

35. A sealing device as set forth in either claim 17 or 25, wherein said holder is made of an elastic material.

36. A process cartridge as set forth in claim 35, wherein said elastic material is one of polypropylene or polyethylene.

37. A sealing device as set forth in either claim 17 or 25, wherein said first sealing member and said second sealing member are attached to said holder with double-sided adhesive tape.

38. An assembling method of a process cartridge having an image bearing member, a process means operative to said image bearing member, and a sealing device for preventing toner from leaking out of a cartridge frame, said assembling method comprising the steps of:

mounting said image bearing member to said cartridge frame;

mounting said process means to said cartridge frame; and attaching a holder having a first sealing member, and a second sealing member separate from said first sealing member, said holder including an attachment portion for detachably attaching said holder to said cartridge frame.

39. An assembling method of a process cartridge as set forth in claim 38, wherein said attachment of said holder comprises one of a projection or an indentation, and wherein said sealing device is detachably attached to said cartridge frame by engaging by friction said one of a projection or an indentation with one of an indentation or a projection formed on said cartridge frame.

40. An image forming apparatus, attachable and detachable of a process cartridge, for forming an image on recording media, comprising:

mounting means for detachably mounting a process cartridge including:

an electrophotographic photosensitive drum; cleaning means for removing toner remaining on said electrophotographic photosensitive drum;

a cartridge frame;

a holder having an attachment for detachably attaching the holder to said cartridge frame;

a first sealing member, attached to said holder, to prevent the toner from leaking out of said cartridge frame, capable of contacting both a cleaning blade, as a component of said cleaning means, for scraping off the toner from a curved face of said electrophotographic photosensitive drum and a blade supporter, as a component of said cleaning means, for supporting said cleaning blade;

a second sealing member, attached to said holder, separate from said first sealing member, and to prevent the toner from leaking out of said cartridge frame, capable of contacting to a collecting sheet, as a component of said cleaning means, for introducing scraped toner from said electrophotographic photosensitive drum into a toner reservoir by said cleaning blade; and a third sealing member, separate from said first and second sealing members, and capable of contacting said electrophotographic photosensitive drum; and conveying means for conveying and recording media.

* * * * *

UNITED STATES PATENT AND TRADEMARK OFFICE

CERTIFICATE OF CORRECTION

PATENT NO. : 5,502,547

DATED : March 26, 1996

INVENTOR(S) : MASANARI SHIRAI

It is certified that error appears in the above-indentified patent and that said Letters Patent is hereby corrected as shown below:

COLUMN 1

Line 12, delete "of";
Line 23, "energy or" should read --energy,--; and
Line 43, " "toner " " should read --"toner")--.

COLUMN 2

Line 40, "the life" should read --or the like--; and
Line 41, "out them" should read --them out--.

COLUMN 5

Line 48, "costruction" should read --construction--; and
Line 59, "an" should read --a--.

COLUMN 6

Line 32, "uses, so called, the" should read --uses the so-called--; and
Line 54, "10a 2" should read --10a2--.

COLUMN 7

Line 12, "slightly" should read --sliding--;
Line 18, "whatever." should read --the like.--; and
Line 33, "members" should read --member--.

UNITED STATES PATENT AND TRADEMARK OFFICE

CERTIFICATE OF CORRECTION

PATENT NO. : 5,502,547

DATED : March 26, 1996

INVENTOR(S) : MASANARI SHIRAI

It is certified that error appears in the above-indentified patent and that said Letters Patent is hereby corrected as shown below:

COLUMN 8

Line 45, "groove 12b 1" should read --groove 12b1--; and
Line 57, "as" should read --as by--.

COLUMN 9

Line 3, "not likewise" should read --unlike--;
Line 37, "scaling" should read --sealing--;
Line 40, "scaling" should read --sealing--;
Line 41, "scaling" should read --sealing--;
Line 43, "scaling" should read --sealing--;
Line 55, "scaling members 18a18b," should read --sealing members 18a,18b,--, and "arc" should read --are--;
Line 58, "scaling" should read --sealing--;
Line 59, "scaling" should read --sealing--;
Line 60, "scaling" should read --sealing--; and
Line 65, "scaling" should read --sealing--.

COLUMN 10

Line 48, "gather" should read --gathered--.

COLUMN 11

Line 20, "29e" should read --25e--; and
Line 24, "29e" should read --25e--.

UNITED STATES PATENT AND TRADEMARK OFFICE

CERTIFICATE OF CORRECTION

PATENT NO. : 5,502,547

DATED : March 26, 1996

INVENTOR(S) : MASANARI SHIRAI

It is certified that error appears in the above-indentified patent and that said Letters Patent is hereby corrected as shown below:

COLUMN 13

Line 57, "whatever)." should read --the like).--, and delete "to"; and
Line 59, "so called the" should read --the so-called--.

COLUMN 14

Line 1, "whatever" should read --the like--;
Line 3, "whatever" should read --the like--;
Line 53, "member," should read --sealing member,--; and
Line 55, delete "said cartridge frame".

COLUMN 15

Line 44, "said" should read --and said--; and
Line 53, "claim 1," should read --claims 1,--.

COLUMN 16

Line 21, "process" should read --process cartridge--;
Line 34, "are" should read --which are--;
Line 35, "detachable" should read --detachably--;
Line 43, "detachable" should read --detachably--;
Line 47, "means," should read --means--;
Line 50, "detachable" should read --detachably--; and
Line 53, "carriage" should read --cartridge--.

UNITED STATES PATENT AND TRADEMARK OFFICE

CERTIFICATE OF CORRECTION

PATENT NO. : 5,502,547

DATED : March 26, 1996

INVENTOR(S) : MASANARI SHIRAI

It is certified that error appears in the above-indentified patent and that said Letters Patent is hereby corrected as shown below:

COLUMN 17

Line 5, delete "to";
Line 55, "frame," should read --frame;--;
Line 58, delete "to";
Line 60, "frame," should read --frame;--; and
Line 61, "said recording media" should read --a recording medium--.

COLUMN 18

Line 41, "member," should read --member--; and
Line 59, "drum; cleaning" should read --drum; ¶ cleaning--.

COLUMN 19

Line 9, delete "to".

UNITED STATES PATENT AND TRADEMARK OFFICE

CERTIFICATE OF CORRECTION

PATENT NO. : 5,502,547 Page 5 of 5

DATED : March 26, 1996

INVENTOR(S) : MASANARI SHIRAI

It is certified that error appears in the above-indentified patent and that said Letters Patent is hereby corrected as shown below:

COLUMN 20

Line 7, "and" should read --the--.

Signed and Sealed this

Eleventh Day of February, 1997

Bruce Lehman

*Attest:*

BRUCE LEHMAN

*Attesting Officer*

*Commissioner of Patents and Trademarks*